US010000088B2

(12) United States Patent
Hoshino

(10) Patent No.: US 10,000,088 B2
(45) Date of Patent: Jun. 19, 2018

(54) WRITING INSTRUMENT AND INK CARTRIDGE

(71) Applicant: Kabushiki Kaisha Pilot Corporation, Tokyo (JP)

(72) Inventor: Takanori Hoshino, Nagoya (JP)

(73) Assignee: Kabushiki Kaisha Pilot Corporation, Tokyo (JP)

( * ) Notice: Subject to any disclaimer, the term of this patent is extended or adjusted under 35 U.S.C. 154(b) by 80 days.

(21) Appl. No.: 15/023,761

(22) PCT Filed: Sep. 16, 2014

(86) PCT No.: PCT/JP2014/074365
§ 371 (c)(1),
(2) Date: Mar. 22, 2016

(87) PCT Pub. No.: WO2015/041202
PCT Pub. Date: Mar. 26, 2015

(65) Prior Publication Data

US 2016/0229218 A1 Aug. 11, 2016

(30) Foreign Application Priority Data

Sep. 23, 2013 (JP) ..... 2013-196302
Oct. 23, 2013 (JP) ..... 2013-219721
Mar. 28, 2014 (JP) ..... 2014-068954

(51) Int. Cl.
*B43K 8/12* (2006.01)
*B43K 5/14* (2006.01)
(Continued)

(52) U.S. Cl.
CPC ..... *B43K 5/145* (2013.01); *B43K 5/14* (2013.01); *B43K 7/02* (2013.01); *B43K 7/08* (2013.01);
(Continued)

(58) Field of Classification Search
CPC ... B43K 8/02; B43K 8/03; B43K 8/04; B43K 8/08; B43K 8/022; B43K 5/14
(Continued)

(56) References Cited

U.S. PATENT DOCUMENTS 1,826,195 A 10/1931 Wooldridge
2,045,774 A 6/1936 Hirschy
(Continued)

FOREIGN PATENT DOCUMENTS

GB 2173743 A 10/1986
GB 2405615 A 3/2005
(Continued)

*Primary Examiner* — Jennifer C Chiang
(74) *Attorney, Agent, or Firm* — The Webb Law Firm

(57) ABSTRACT

A writing instrument includes: a replacement ink cartridge including a bottomed cylindrical container that has an opened front end and a closed rear end and a plug fitted into an inner circumferential surface of an opening of the container; and a projection inserted into the opening of the container to press the plug rearward, thereby opening the plug of the ink cartridge, wherein the projection and the plug are fitted when the plug is press opened, and when the cartridge is replaced, the fitting between the projection and the plug is released and the plug is locked again in the opening of the container.

23 Claims, 10 Drawing Sheets

(51) Int. Cl.

| | |
|---|---|
| ***B43K 8/03*** | (2006.01) |
| ***B43K 7/02*** | (2006.01) |
| ***B43K 7/08*** | (2006.01) |
| ***B43K 7/10*** | (2006.01) |
| ***B43K 8/02*** | (2006.01) |
| ***B43K 8/04*** | (2006.01) |
| ***B43K 8/08*** | (2006.01) |
| *B43K 5/18* | (2006.01) |

(52) U.S. Cl.
CPC ..... *B43K 7/10* (2013.01); *B43K 8/02* (2013.01); *B43K 8/022* (2013.01); *B43K 8/03* (2013.01); *B43K 8/04* (2013.01); *B43K 8/08* (2013.01); *B43K 5/18* (2013.01)

(58) Field of Classification Search
USPC ..... 401/207
See application file for complete search history.

(56) References Cited

U.S. PATENT DOCUMENTS

| | | | | |
|---|---|---|---|---|
| 7,850,385 | B2 * | 12/2010 | Noguchi | B43K 5/025 401/198 |
| 2016/0288561 | A1 * | 10/2016 | Hoshino | B43K 5/14 |

FOREIGN PATENT DOCUMENTS

| | | | |
|---|---|---|---|
| JP | 3721906 | | 8/1962 |
| JP | 555341 | Y2 | 11/1977 |
| JP | 64943 | Y2 | 2/1990 |
| JP | 8216583 | A | 8/1996 |
| JP | 2001287494 | A | 10/2001 |

* cited by examiner

WRITING INSTRUMENT AND INK CARTRIDGE

CROSS-REFERENCE TO RELATED APPLICATIONS

This application is the United States national phase of International Application No. PCT/JP2014/074365 filed Sep. 16, 2014, and claims priority to Japanese Patent Application Nos. 2013-196302, 2013-219721, and 2014-068954 filed Sep. 23, 2013, Oct. 23, 2013, and Mar. 28, 2014, respectively, the disclosures of which are hereby incorporated in their entirety by reference.

TECHNICAL FIELD

The present invention relates to a writing instrument and an ink cartridge. Specifically, it relates to a writing instrument using a replacement ink cartridge and a replacement ink cartridge constituting such writing instrument.

BACKGROUND ART

In the field of conventional writing instruments with a built-in replaceable ink cartridge, ink cartridges directly storing ink in a container having an open end and blocking the opening by a ball or a disk shaped plug are widely used. An ink-guidable tubular projection formed in a writing instrument body is engaged and connected to such cartridge from the front end opening, thereby press opening the plug. The ink in the container is thus introduced into the tubular projection to start ink supply to the pen point (for example, refer to Patent Documents 1 through 3).

Since a writing instrument of this type is capable of easily writing again, after ink in the ink cartridge is used up, by replacement with a new ink cartridge, it is widely spread in general from the perspective of high recycling and ink filling efficiencies of the writing instrument body.

However, when a used cartridge container is pulled out for ink cartridge replacement, the ink remained inside the container sometimes leaks to the outside depending on the speed of pulling out and the orientation of the container. In the structure of Patent Document 4, since the range of movement of a plug after the plug is opened is restricted, the above ink leakage does not easily occur relatively in comparison with other structures. In spite of that, the plug is freely movable in the plug opening state and thus makes contact with the container inner wall every time the plug moves to produce a noise. Further, when a strong impact such as falling occurs, the plug accelerated by the movement strongly collides with the connection portion and the container bottom wall, and thus deformation of the connection portion or lifting (shifting) or disengagement of the cartridge sometimes occurs, causing ink leakage.

PRIOR ART DOCUMENTS

Patent Document

Patent Document 1: Japanese Patent Application Kokai Publication No. 2001-287494

Patent Document 2: Japanese Patent Application Kokai Publication No. H8-216583

Patent Document 3: Japanese Utility Model Publication No. H6-4943

Patent Document 4: Japanese Utility Model Publication No. S55-5341

DISCLOSURE OF THE INVENTION

Problems to be Solved by the Invention

The present invention is to provide a writing instrument and an ink cartridge, having high cartridge replaceability and excellent convenience, capable of suppressing inappropriate ink leakage that easily occurs when a used cartridge container is pulled out even when the writing instrument uses a replacement ink cartridge with a plug to be press opened.

Means to Solve the Problems (1) A writing instrument according to a first aspect of the present invention is a writing instrument, having a configuration including: a writing instrument body provided with a pen point to be a writing tip end at a front end of a barrel; and a replacement ink cartridge provided with a tubular container having an opened front end and a closed rear end, wherein the ink cartridge has a plug fitted in an inner circumferential surface of an opening of the container and blocking the opening, the writing instrument body has a projection pressing the plug rearward when inserted into the opening of the container to release fitting between the plug and the inner circumferential surface of the opening of the container, the fitting between the plug and the inner circumferential surface of the opening of the container is released in a procedure of attaching the ink cartridge to the writing instrument body, and the plug blocks the opening of the container again in a procedure of detaching the ink cartridge from the writing instrument body.

(2) It is preferred that the writing instrument of (1) above has a configuration where the projection and the plug are fitted in the procedure of attaching the ink cartridge to the writing instrument body, and in the procedure of detaching the ink cartridge from the writing instrument body, fitting between the projection and the plug is released and the plug is fitted again in the inner circumferential surface of the opening of the container.

(3) It is preferred that the writing instrument of (1) or (2) above has a configuration where the inner circumferential surface of the opening of the container is formed in a tapered shape widened rearwardly.

(4) It is preferred that the writing instrument of any of (1) through (3) above has a configuration where the projection is an ink-guiding tube having an outer circumferential surface to be air tight fitted in the inner circumferential surface of the opening of the container and the ink-guiding tube has a wall provided with an ink intake portion allowing ink to flow through the ink-guiding tube in a state of fitting in the plug.

(5) A writing instrument according to a second aspect of the present invention is the writing instrument of (2) above has a configuration where any one of the plug and the projection is provided with a male fitting portion and the other is provided with a female fitting portion, the male fitting portion and the female fitting portion are fitted in the procedure of attaching the ink cartridge to the writing instrument body, and, in the procedure of detaching the ink cartridge from the writing instrument body, fitting between the male fitting portion and the female fitting portion is released and the plug is fitted again in the inner circumferential surface of the opening of the container.

(6) It is preferred that the writing instrument of (5) above has a configuration where the male fitting portion is a small protrusion with a diameter less than diameters of the plug and the projection and the female fitting portion is a small bore smaller than the diameters of the plug and the projection, in the procedure of attaching the ink cartridge to the writing instrument body, the small protrusion is inserted into the small bore and the small protrusion is fitted in the small bore, and, in the procedure of detaching the ink cartridge from the writing instrument body, fitting between the small protrusion and the small bore is released and the plug is fitted again in the inner circumferential surface of the opening of the container.

(7) It is preferred that the writing instrument of (6) above has a configuration where a part of an outer circumferential surface of the small protrusion is provided with a first shape and a part of an inner circumferential surface of the small bore is provided with a second shape corresponding to the first shape, and a fitted state of the small protrusion and the small bore is formed by coupling the first shape to the second shape.

(8) It is preferred that the writing instrument of any of (5) through (7) above has a configuration where the plug is provided with a plug portion having an outer circumferential surface capable of being fitted in the inner circumferential surface of the opening of the container and an ink intake portion provided in a rear of the plug portion and allowing ink in the container to flow therethrough.

(9) It is preferred that the writing instrument of any of (5) through (8) above has a configuration where the inner circumferential surface of the opening of the container includes a cylindrical inner circumferential surface with an identical diameter provided in a front and a tapered inner circumferential surface with a rearwardly increasing diameter continuously provided in a rear of the cylindrical inner circumferential surface.

(10) It is preferred that the writing instrument of (5) above has a configuration where the projection is an ink-guiding tube having an outer circumferential surface to be air tight fitted in the inner circumferential surface of the opening of the container and a pressing piece partially projecting from a periphery of a wall portion of the ink-guiding tube configures the male fitting portion, the plug is a plate member fitted in the inner circumferential surface of the opening of the container and a clamping piece provided in a peripheral portion of the plug configures the female fitting portion, the pressing piece and the clamping piece are fitted in the procedure of attaching the ink cartridge to the writing instrument body, and, in the procedure of detaching the ink cartridge from the writing instrument body, fitting between the pressing piece and the clamping piece is released and the plug is fitted again in the inner circumferential surface of the opening of the container.

(11) A writing instrument according to a third aspect of the present invention is the writing instrument of (1) above has a configuration including: the ink cartridge including the container in a bottomed cylindrical shape having the opened front end and the closed rear end and the plug fitted into the inner circumferential surface of the opening of the container; and the projection inserted into the opening of the container to press the plug rearward, thereby opening the plug of the ink cartridge, wherein, when the ink cartridge is connected, the press opened plug is in a state of approximately making contact with the projection and the plug is approximately clamped by the projection and a part of an inner wall of the container and its movement is suppressed, and, when the ink cartridge is replaced in a state of the opening of the container oriented downward, the plug moves by its own weight to be locked again in the opening of the container.

(12) It is preferred that the writing instrument of (11) above has a configuration where a stepped portion is formed in the part of the inner wall of the container, and when the ink cartridge is connected, the stepped portion, together with the projection, restricts the movement of the plug.

(13) It is preferred that the writing instrument of (12) above has a configuration where the stepped portion is a longitudinal rib formed in the inner wall of the container, a plurality of which are formed in an inner circumference of the container.

(14) It is preferred that the writing instrument of any of (11) through (13) above has a configuration where an inner circumference of the opening of the container is formed in a tapered shape widened rearwardly.

(15) It is preferred that the writing instrument of any of (11) through (14) above has a configuration where the projection is an ink-guiding tube air tight fitted in an inner circumference of the opening of the container and the ink-guiding tube has a wall provided with an ink intake portion for intake of ink in a state of making contact with the plug.

(16) An ink cartridge according to the first aspect of the present invention is an ink cartridge constituting the writing instrument according to any of (2) through (4) above, having a configuration having the plug fitted in the inner circumferential surface of the opening of the container, wherein the plug is, in the procedure of attaching the ink cartridge to the writing instrument body, pressed rearward by the projection to release the fitting with the inner circumferential surface of the opening of the container and to be fitted in the projection, and, in the procedure of detaching the ink cartridge from the writing instrument body, releases the fitting with the projection and is fitted again in the inner circumferential surface of the opening of the container.

(17) It is preferred that the ink cartridge of (16) above has a configuration where the inner circumferential surface of an opening of the container is formed in a tapered shape widened rearwardly.

(18) An ink cartridge according to the second aspect of the present invention is an ink cartridge constituting the writing instrument according to any of (5) through (10) above, having a configuration having the plug fitted in the inner circumferential surface of the opening of the container, wherein the plug is provided with any one of the male fitting portion or the female fitting portion, and the plug is, in the procedure of attaching the ink cartridge to the writing instrument body, pressed rearward by the projection to release the fitting with the inner circumferential surface of the opening of the container and the male fitting portion or the female fitting portion provided in the plug is fitted in the female fitting portion or the male fitting portion provided in the projection, and in the procedure of detaching the ink cartridge from the writing instrument body, releases fitting between the male fitting portion or the female fitting portion provided in the plug and the female fitting portion or the male fitting portion provided in the projection and is fitted again in the inner circumferential surface of the opening of the container.

(19) It is preferred that the ink cartridge of (18) above has a configuration where the male fitting portion is a small protrusion with a diameter less than diameters of the plug and the projection and the female fitting portion is a small bore smaller than the diameters of the plug and the projection, the plug is provided with any one of the small protrusion or the small bore, in the procedure of attaching the ink cartridge to the writing instrument body, the small protrusion or the small bore provided in the plug is fitted in the small bore or the small protrusion provided in the projection, and, in the procedure of detaching the ink cartridge from the writing instrument body, fitting between the small protrusion or the small bore provided in the plug and the small bore or the small protrusion provided in the projection is released and the plug is fitted again in the inner circumferential surface of the opening of the container.

(20) It is preferred that the ink cartridge of (18) or (19) above has a configuration where the plug is provided with a plug portion having an outer circumferential surface capable of being fitted in the inner circumferential surface of the opening of the container and an ink intake portion provided in a rear of the plug portion and allowing ink in the container to flow therethrough.

(21) It is preferred that an ink cartridge of any of (18) through (20) above has a configuration where the container is in a cylindrical shape with the opened front end and the closed rear end and has an outer diameter on a front end side to be inserted into a rear end opened area of the barrel of the writing instrument body of 12 mm or less.

(22) It is preferred that the ink cartridge of (21) above has a configuration where the opening of the container has an inner diameter within a range from 3 to 8 mm.

(23) An ink cartridge according to the third aspect of the present invention is an ink cartridge attachable to the writing instrument body constituting the writing instrument according to any of (1) through (3) above, having a configuration where having the plug fitted in the inner circumferential surface of the opening of the container, wherein the plug is, when the ink cartridge is connected, in the state of approximately making contact with the projection and is approximately clamped by the projection and a part of an inner wall of the container and its movement is suppressed, and, when the ink cartridge is replaced in the state of the opening of the container oriented downward, moves by its own weight to be locked again in the opening of the container.

(24) An ink cartridge according to a fourth aspect of the present invention is an ink cartridge attachable to the writing instrument body constituting the writing instrument according to any of (1) through (15) above, where at least a front end side of the container has a shape and a dimension attachable in the barrel of the writing instrument body, and when the container is attached in the barrel of the writing instrument body, ink stored in the container is supplied from the opening of the container to the pen point provided at the front end of the barrel of the writing instrument body

(25) It is preferred that the ink cartridge of (24) above has a configuration having the plug fitted in the inner circumferential surface of the opening of the container, wherein the plug is, when the projection is inserted into the opening of the container, pressed rearward by the projection to release the fitting with the inner circumferential surface of the opening of the container.

(26) It is preferred that the ink cartridge of (24) or (25) above has a configuration where the container has an outer circumferential surface formed with a male thread and the male thread is screwed to a female thread formed in an inner circumferential surface of a rear end opened area of the barrel of the writing instrument body.

In the present invention, "front" means the pen point side in the writing instrument and the opening side in the cartridge, and "rear" means the opposite side.

Effects of the Invention

According to the present invention, even when a replacement ink cartridge with a plug to be press opened is used, it is possible to suppress inappropriate ink leakage that easily occurs when a used cartridge container is pulled out and thus a writing instrument is achieved that has high cartridge replaceability and is excellent in convenience.

BRIEF DESCRIPTION OF THE DRAWINGS

FIG. 4(*b*) illustrates a state of a writing instrument body and an ink cartridge, constituting the writing instrument in FIG. 4(*a*), being separated (before use). FIG. 4(*c*) illustrates a state in a procedure of separating the ink cartridge from the writing instrument body, constituting the writing instrument in FIG. 4(*a*).

FIG. 5(*b*) is an enlarged cross-sectional view of the area that is cut horizontally of coupling the ink cartridge to the writing instrument body, constituting the writing instrument in FIG. 4(*a*).

FIG. 6(*b*) is a cross-sectional view of the intermediate member in FIG. 6(*a*) that is cut horizontally.

FIG. 7(*a*) illustrates a state of obliquely viewing the plug from a back side. FIG. 7(*b*) illustrates a state of obliquely viewing the plug from a front side. FIG. 7(*c*) is a cross-sectional view of the plug.

FIG. 10(*b*) is a cross-sectional view illustrating a fitted state of a projection of the writing instrument body and the ink cartridge. FIG. 10(*c*) is a cross-sectional view illustrating a fitted state of the opening and the plug of the ink cartridge detached from the writing instrument body.

FIG. 11(*b*) illustrates a state of attaching (in use) an ink cartridge to a writing instrument body constituting the writing instrument in FIG. 11(*a*). FIG. 11(*c*) illustrates a state in a procedure of separating the ink cartridge from the writing instrument body constituting the writing instrument in FIG. 11(*a*).

MODES FOR CARRYING OUT THE INVENTION

First Embodiment

The first embodiment of a writing instrument of the present invention is described below with reference to FIGS. 1 through 3. The present invention is not limited to the embodiments described below.

Figure 1:
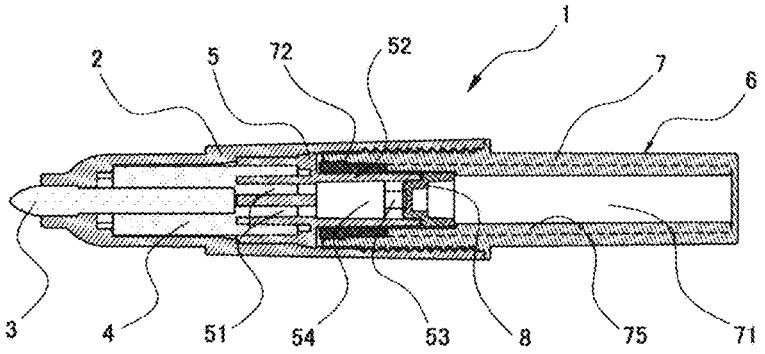
FIG. 1 is a cross-sectional view illustrating a writing instrument according to a first embodiment of the present invention.
Figure 2:
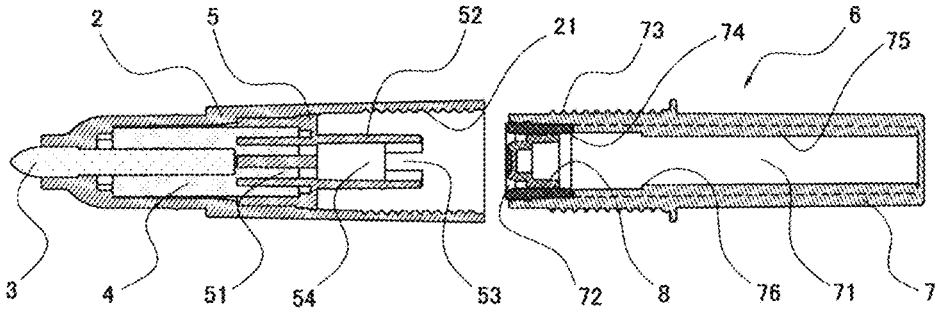
FIG. 2 is a cross-sectional view illustrating a state of a writing instrument body and an ink cartridge, constituting the writing instrument in FIG. 1, being separated (before use).
Figure 3:
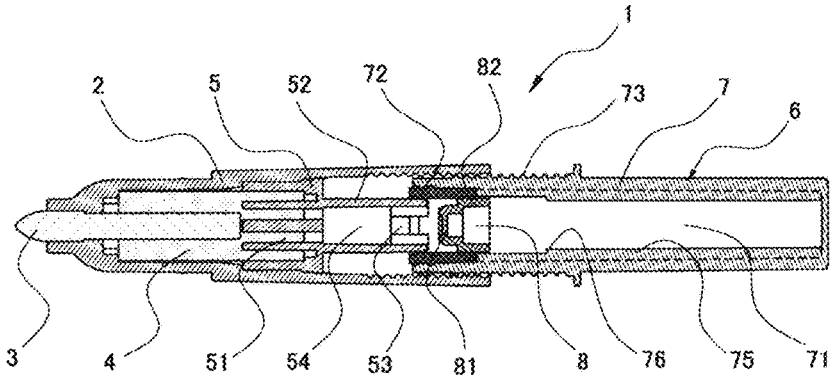
FIG. 3 is a cross-sectional view illustrating a state in a procedure of separating the ink cartridge from the writing instrument body constituting the writing instrument in FIG. 1.

A writing instrument 1 in the first embodiment illustrated in FIGS. 1 through 3 is a capped writing instrument (a cap is not shown) configured with a writing instrument body that is provided with a pen point 3 to be a writing tip end at a barrel 2 front end and that has an ink absorber 4 and an intermediate member 5 disposed in the barrel 2 and an ink cartridge 6 that directly stores ink in a bottomed cylindrical container 7 and that blocks an opening 72 thereof by a plug 8.

The writing instrument 1 is a writing instrument of a direct fluid type having the barrel 2 (an approximately cylindrical resin molding in a rear end opened shape retaining the pen point 3 at a front end and having the ink absorber 4 and the intermediate member 5 built therein), as a writing instrument body, that is provided with the pen point 3, the ink absorber 4 connected to a rear end of the pen point 3, and the intermediate member 5 arranged in the rear of the ink absorber 4 (provided with communication pipes 51 for ink guidance in the front and a projection 52 for connection in the rear). Further, the ink cartridge 6 is inserted from the rear end opened area of the barrel 2 and is air tight fitted in the projection 52 while being screwed to the barrel 2, thereby making a writing instrument form.

The pen point 3 is a rod-like marking pen tip obtained by resin treatment of synthetic resin fiber (for example, polyester fiber, acrylic fiber, nylon fiber, etc.). Although a front end of the pen point 3 is ground in a bullet shape, those processed in a general purpose shape, such as a chisel shape, are applicable. Further, other than a marking pen tip, it is also possible to use a ballpoint pen tip and the like.

The ink absorber 4 is made with a columnar processed object of synthetic resin fiber (for example, polyester fiber). The outer circumferential surface of the ink absorber 4 is covered with a cylindrical outer skin. The outer skin is made with a film of a synthetic resin (for example, a film of polyethylene terephthalate). A rear end of the pen point 3 hits and is inserted into the axial center of a front end surface of the ink absorber 4, and the rear end of the pen point 3 is positioned in the front of inside the ink absorber 4.

For the ink absorber, those for general purpose may be used as long as it has a structure that is capable of temporarily retaining ink, and it is also possible to use an accordion-like ink holding member (pen core) and the like.

The barrel 2 is a tubular object obtained by injection molding of a synthetic resin (for example, polypropylene, polyethylene, etc.) and has a tapered front end retaining a pen point outer circumferential surface and is molded in one member through a rear end opening area. Further, the ink absorber 4 and the intermediate member 5 (and further, an ink cartridge 6 front side in a connected state) are disposed inside and thread ridges 21 (female thread) to which the cartridge 6 is screwed are formed in the rear. In a position where the intermediate member 5 is disposed, an annular rib is formed to have a structure fit retaining the intermediate member 5 in a specific position.

As a specific structure, a plurality of ribs extending longitudinally are integrally formed in an internal surface of the barrel 2 and the outer circumferential surface of the ink absorber 4 is pressure fit retained by the ribs. A rib is also formed in an internal surface of the tapered portion to pressure fit retain an outer circumferential surface of the pen point 3.

By the ribs, air paths are formed between the outer circumferential surface of the ink absorber 4 and the internal surface of the barrel 2 and between the outer circumferential surface of the pen point 3 and the internal surface of the tapered portion.

The intermediate member 5 is obtained by injection molding of a synthetic resin (for example, polypropylene, polyethylene, etc.). The intermediate member 5 is made with one member provided with an approximately disk-shaped partition wall dividing the ink absorber 4 and the ink cartridge 6, a plurality (specifically, two) of communication pipes (axially provided with ink guiding portions 51) projecting forward from a front surface of the partition wall and hitting and connected inside the ink absorber 4, and a cylindrical projection (ink-guiding tube) 52 projecting rearward from a rear surface of the partition wall and air tight connected by being inserted into a front end opening of the ink cartridge 6. Therefore, when being written, cartridge ink flowed into the projection 52 is supplied to the pen point through the ink guiding portions 51. An annular stepped portion is formed in an outer circumference of the partition wall to be fixed by being fitted in the internal surface (annular rib) of the barrel 2.

A rear end of the projection 52 has a structure of being fitted in the plug 8 when the cartridge is connected. The fitting means a connected state allowing both the projection 52 and the plug 8 to move for installation and removal of the cartridge.

Further, in order to allow the ink in the cartridge to be securely flowed into the projection 52 (channel 54) even in a fitted state with the plug 8, a wall of the cylinder (projection rear end) is provided with notches (specifically, in two facing spots), and the notches act as an ink intake portion 53. In the present embodiment, by providing the notches, the projection rear end deflects to clamp the plug 8 when the cartridge is connected, and thus a higher fitting force is exhibited to allow easy press opening of the plug, and also when the cartridge is replaced, secure movement to near the cartridge opening without disengagement of the plug 8. The clamping force of the projection rear end is then diminished, and thus a structure is achieved that allows the fitting between the projection 52 and the plug 8 to be released in an opening blocking state for easy disengagement of the cartridge. Therefore, inappropriate ink leakage that occurs when the cartridge 6 is pulled out with a strong force does not easily occur even more.

The ink intake portion 53 may be a through hole formed in the wall of the cylinder other than the notches described above.

The projection 52 in the present embodiment is one member that serves both as a pressing plug-opening portion and an air tight connection portion and thus has a structure of forming an air tight state with an opening inner circumferential surface of the cartridge 6 by forming an annular rib in the outer circumferential surface, whereas it may be surface contact or it is also possible to separately provide an air tight connection portion. In that case, by forming an annular rib in the outer circumferential surface near the opening of the ink cartridge 6, it is also possible to use other structures that do not cause ink leakage, such as a structure of retaining the connection of the outer circumferential surface of the ink cartridge 6 (opening 72) in an air tight state and a structure of forming an air tight state with the opened front surface of the cartridge 6 and the partition wall of the intermediate member 5.

The ink cartridge 6 is a bottomed cylindrical object with an opened front end and a closed rear end and obtained by injection molding or blow molding of a synthetic resin (specifically, a polypropylene resin) in such a manner that thread ridges 73 for screw fitting (male thread) are integrally formed in an opening side outer surface. The plug 8 is fitted into an inner wall of a front opened area (opening 72) of the container.

Inside the container 7 is applied as an ink storage portion 71 to directly store oil based ink (the ink is not shown), and the opening 72 obtained by fitting a separate member is formed in the front of in order to tightly seal the inner circumferential surface by the plug 8 in a cup shape. Near the opening (in the present embodiment, a rear end area 74 of the separate member) is formed in a tapered shape widened rearwardly and has a structure easily blocking the opening 72 without being caught due to the movement of the plug 8 to the opening side when the cartridge is replaced.

Further, a plurality of longitudinal ribs 75 are formed in the inner wall of the container 7 at regular interval for smooth movement of the ink in the container, and a stepped portion 76 obtained by lowering the height on the opening side of each rib 75 restricts downward movement of the plug 8. Therefore, even when the fitting between the projection 52 and the plug 8 is loosened, it may be near the opening without settling down to a container bottom surface to allow immediate blocking of the opening 72 when the cartridge 6 is disengaged with the opening oriented downward.

The plug 8 is in a stepped cup shape with a smaller diameter on the front side (blocking side) that, when not in use (FIG. 2), tightly seals the inner circumferential surface in a larger diameter area 82 in the rear, and when in use (FIG. 1), is fit clamped in a smaller diameter area 81 in the front by the projection rear end to be pressed rearward. It moves forward together with the projection 52 when the cartridge is replaced to be detached from the projection 52 in the state of blocking near the opening (FIG. 3). Although the blocking position may be controlled in accordance with the fitting force between the projection 52 and the plug 8 (smaller diameter area 81) and the fitting force between the opening 72 and the plug 8 (larger diameter area 82), the opening 72 is blocked by locking the larger diameter area 82 of the plug 8 in a position across a taper 74 in the cartridge opening in the present embodiment (FIG. 3).

The ink cartridge 6 is configured to have, when connected to the writing instrument body (projection 52), the rear end of the container 7 as an end plug for the writing instrument 1 by screwing the thread ridges 73 in the outer circumferential surface of the container 7 to the thread ridges 21 of the barrel 2. Although the container outer circumferential surface of the ink cartridge 6 is connected by being screwed to the writing instrument body (barrel 2) in the present embodiment, a connection method, such as fitting, may also be used. In addition, although a stepped cup is used as the plug 8, a conventionally known form, such as a spherical shape, a disk shape, and a thin shape integrally formed with the opening 72, may be used as long as it may be press opened to be connected to the projection 52 at that time.

As the oil based ink, oil based ink for writing board containing additives, such as pigments, a resin, and a remover, using, for example, ethanol and isopropyl alcohol as a solvent is applied that is excellent in handwriting drying properties and erasability when being written. An ink composition applied to the present invention is not limited to the above type and may be oil based ink not containing a remover or water based ink containing water as a main solvent.

As a specific method of using the writing instrument 1 of the present invention, the ink cartridge 6 is inserted from the rear end opened area of the writing instrument body (barrel 2) and is further rotated forward, thereby screw inserting the cartridge 6 into the barrel 2 to fit the rear end of the projection 52 in the plug 8, and by further being rotated, the rear end of the projection 52 presses rearward the plug 8 to open the cartridge. At that time, the outer surface of the projection 52 is air tight fitted in the inner circumferential surface of the opening 72 to be in a cartridge connected state.

Then, the ink in the ink cartridge 6 flows into the channel 54 from the ink intake portion 53 (notches) formed in a rear end side surface of the projection 52, and the ink is supplied to the pen point 3 through the ink guiding portions 51 to be in a writing state.

When the ink cartridge 6 is detached after ink consumption, the cartridge 6 (opening 72) may be disengaged from the projection 52 by pulling the cartridge 6 rearward while it is rotated. At this point, both the projection 52 and the plug 8 in the fitted state move in a direction of the opening 72 of the cartridge 6, and after the plug 8 blocks near the opening, the fitted state of the projection 52 and the plug 8 is released. Therefore, even when the cartridge 6 is disengaged without taking care of the orientation of the opening 72 in pulling out, inappropriate leakage of remained ink may be prevented securely.

Second Embodiment

The second embodiment of a writing instrument of the present invention is described with reference to FIGS. 4 through 10. The present invention is not limited to the embodiments described below.

<<Entire Configuration of Writing Instrument>>

Figure 4:
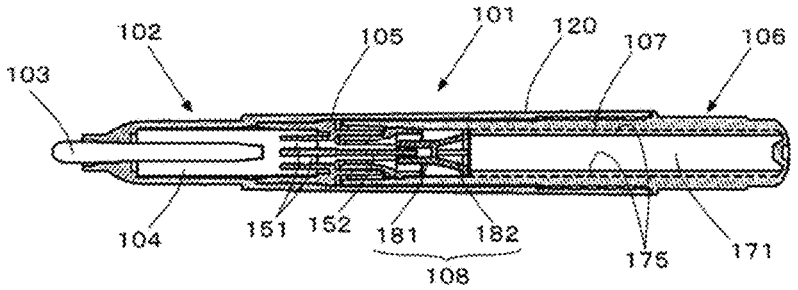
FIG. 4(*a*) is a cross-sectional view illustrating a writing instrument according to a second embodiment of the present invention.
Figure 4:
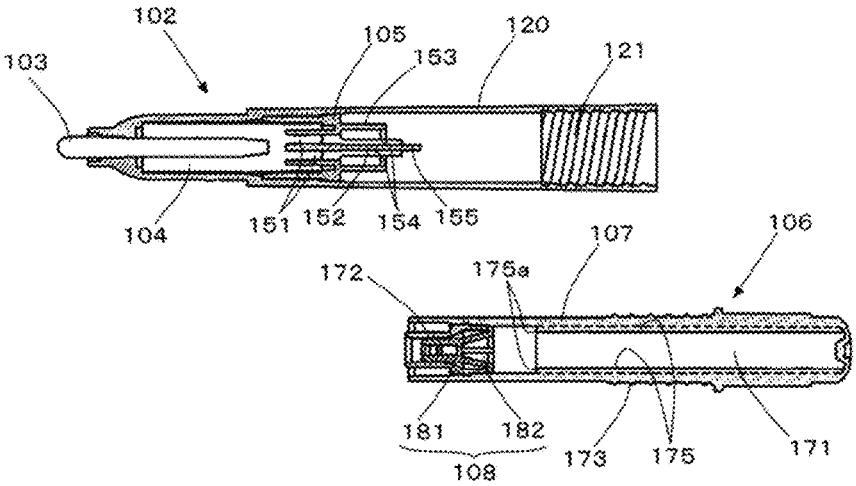
Figure 4:
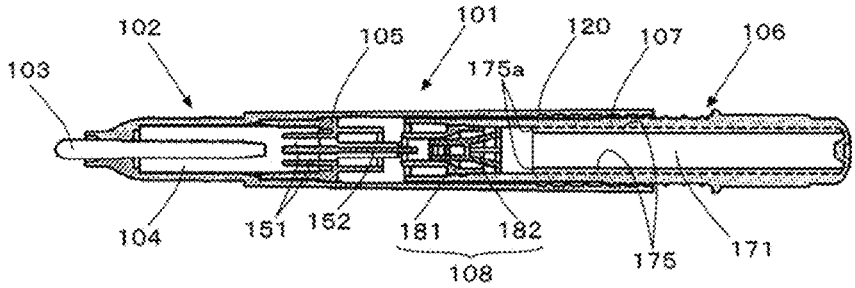
Figure 6:
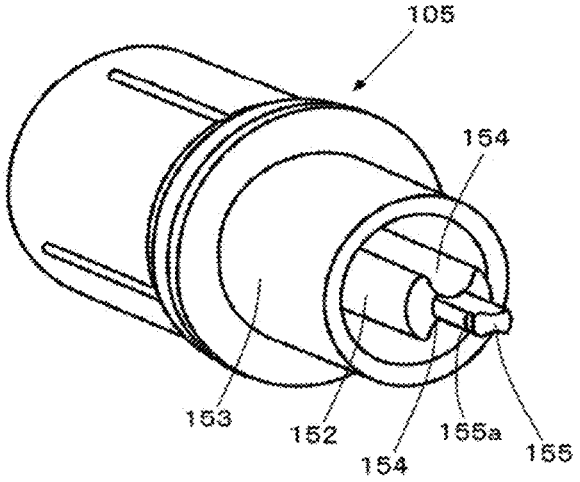
FIG. 6(*a*) is a perspective view illustrating an intermediate member constituting a writing instrument body.
Figure 6:
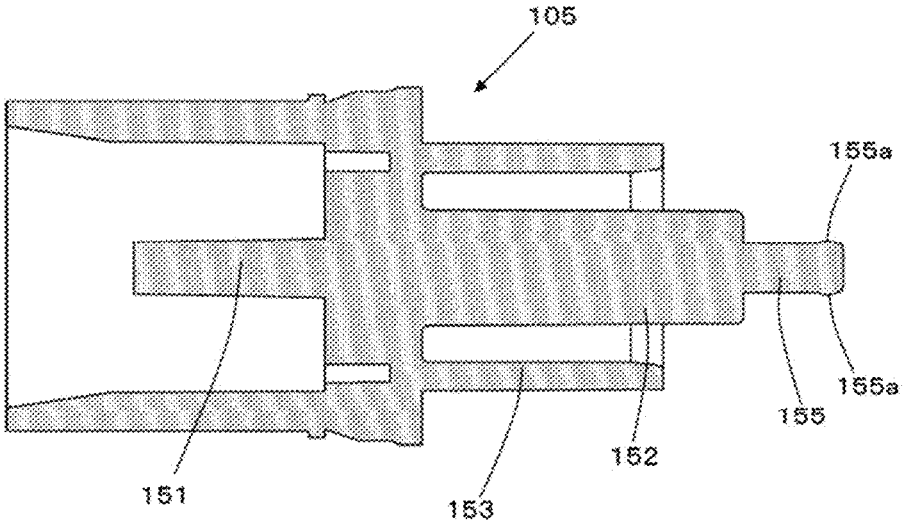
Figure 7A:
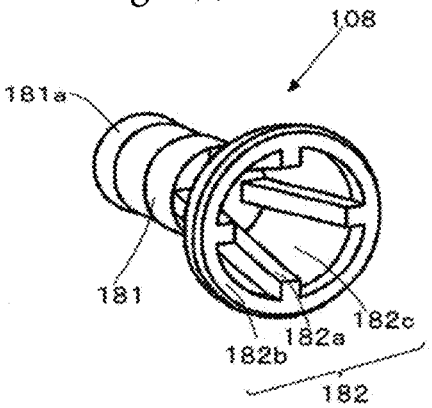
FIGS. 7(*a*) and 7(*b*) are perspective views illustrating a plug constituting an ink cartridge.
Figure 7B:
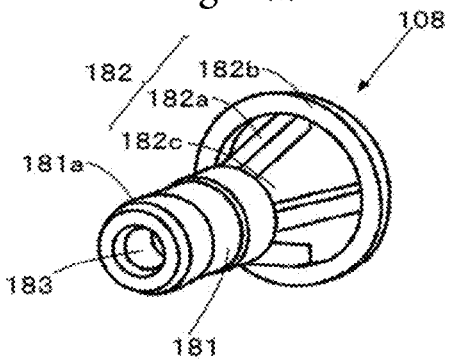
Figure 7C:
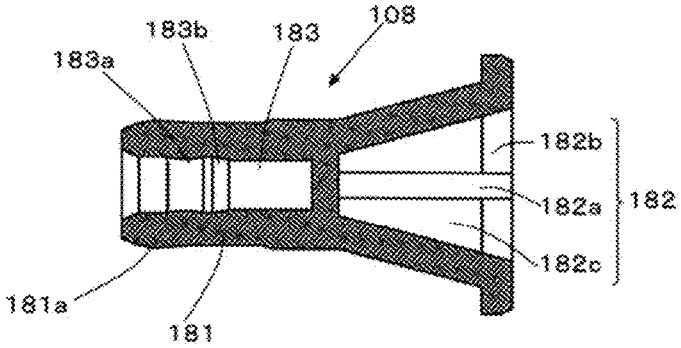
Figure 8:
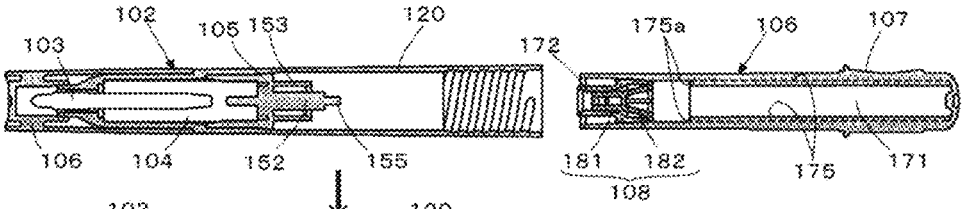
FIGS. 8(*a*) through 8(*e*) are cross-sectional views illustrating a procedure of attaching an ink cartridge to a writing instrument body.
Figure 8:
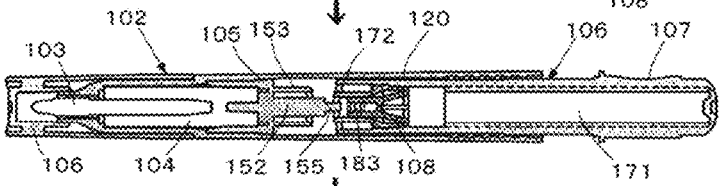
Figure 8:
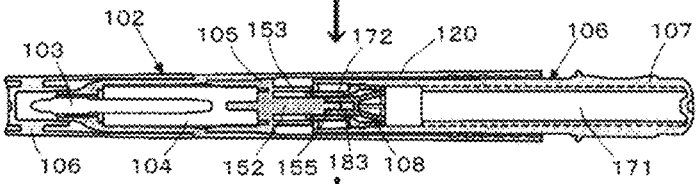
Figure 8:
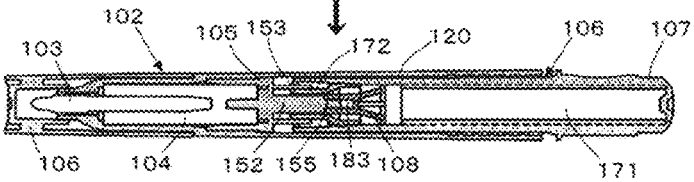
Figure 8:
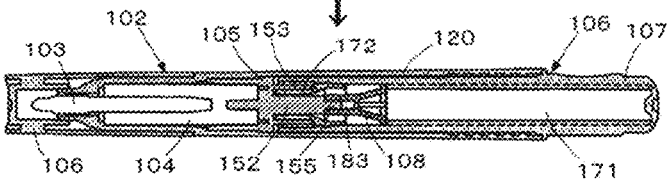

A writing instrument 101 of the second embodiment illustrated in FIGS. 4 through 10 is configured with a writing instrument body 102 and an ink cartridge 106. As illustrated in FIGS. 4(*a*) through 4(*c*), the writing instrument body 102 is provided with a barrel 120. The barrel 120 is an approximately cylindrical resin molding with an open rear end. At a front end of the barrel 120, a pen point 103 to be a writing tip end is installed. In the rear of the pen point 103 inside the barrel 120, an ink absorber 104 is built. To the rear of the ink absorber 104 inside the barrel 120, an intermediate member 105 is attached. As illustrated in FIGS. 8(*a*) through 8(*e*), in a tip end side of the writing instrument body 102, a cap 106 is installed.

As illustrated in FIG. 4(*b*), the ink cartridge 106 is provided with a cylindrical container 107 with an opened front end and a closed rear end. In the container 107, ink is directly stored. To a front end side of the container 107, an opening 172 is attached as a component separate from the container 107. The opening 172 of the ink cartridge 106 before attached to the writing instrument body 102 is blocked from inside by a plug 108.

As illustrated in FIG. 4(*a*), the writing instrument 101 is a writing instrument of a direct fluid type where ink stored in the ink storage portion 171 of the container 107 is supplied straight to the ink absorber 104 in the barrel 120 via the intermediate member 105. In the rear of the intermediate member 105, a projection 152 and an air tight connection portion 153 to be connected to the opening 172 of the container 107 are integrally formed. In the front of the intermediate member 105, ink guiding portions 151 to be communication pipes are integrally formed.

As illustrated in FIG. 4(*b*), an inner circumferential surface of a rear end of the barrel 120 is provided with thread ridges (female thread) 121. Meanwhile, an approximate center of an outer circumferential surface of the container 107 is provided with thread ridges (male thread) 173. The ink cartridge 106 is inserted into a rear end opened area of the barrel 120 and the thread ridges 121 and the thread ridges 173 are screwed to each other, thereby forming the mode of writing instrument illustrated in FIG. 4(*a*). With the screwing of the thread ridges 121 to the thread ridges 173, the projection 152 of the intermediate member 105 is inserted into the opening 172. The projection 152 presses the plug 108 fitted in an inner circumferential surface of the opening 172 rearward to release fitting between the plug 108 and the opening 172. At this time, an outer circumferential surface of the opening 172 is air tight fitted in an inner circumferential surface of the air tight connection portion 153 of the intermediate member 105. The state of coupling the writing instrument body 102 and the ink cartridge 106 described above is illustrated in FIGS. 5(*a*) and 5(*b*).

<<Writing Instrument Body>>

As illustrated in FIG. 4(*b*), the writing instrument body 102 has a configuration provided with the barrel 120, the pen point 103, the ink absorber 104, and the intermediate member 105.

The pen point 103 is a rod-like marking pen tip obtained by resin treatment of synthetic resin fiber (for example, polyester fiber, acrylic fiber, nylon fiber, etc.). Although a front end of the pen point 103 is ground in a bullet shape, those processed in a general purpose shape, such as a chisel shape, are applicable. Further, other than a marking pen tip, it is also possible to use a ballpoint pen tip and the like.

The ink absorber 104 is made with a columnar processed object of synthetic resin fiber (for example, polyester fiber). An outer circumferential surface of the ink absorber 104 is covered with a cylindrical outer skin. The outer skin is made with a film of a synthetic resin (for example, a film of polyethylene terephthalate). In the front of inside the ink absorber 104, a rear end of the pen point 103 is positioned. The rear end of the pen point 3 hits the axial center of a front end surface of the ink absorber 104.

As the ink absorber, those for general purpose may be used as long as it has a structure that is capable of temporarily retaining ink. As the ink absorber, it is also possible to use, for example, an accordion-like ink holding member (pen core) and the like.

The barrel 120 is a tubular object obtained by injection molding of a synthetic resin (for example, polypropylene, polyethylene, etc.). The barrel 120 is integrally formed from the front end to the rear end opened area. The front end of the barrel 120 retaining an outer circumferential surface of the pen point 103 is tapered. As described above, inside the barrel 120, the ink absorber 104 and the intermediate member 105 are disposed. In the inner circumferential surface of the rear end of the barrel 120, the thread ridges (female thread) 121 to be screwed to the ink cartridge 106 are formed. In a position where the intermediate member 105 is disposed in an inner circumferential surface of the barrel 120, an annular rib, not shown, is formed. The annular rib is fitted in an outer circumferential surface of the intermediate member 105 to retain the intermediate member 105 in a specific position.

Although not shown, in the inner circumferential surface on a front side of the barrel 120, a plurality of ribs extending longitudinally are integrally formed. The ribs in the inner circumferential surface on the front side are pressure fitted to the outer circumferential surface of the ink absorber 104 to retain the ink absorber 104 in the barrel 120. The ribs in the inner circumferential surface on the front side form air paths between the outer circumferential surface of the ink absorber 104 and the inner circumferential surface of the barrel 120. Meanwhile, also in an inner circumferential surface at a tapered front end of the barrel 120, ribs, not shown, are formed. The ribs in the inner circumferential surface at the front end are pressure fitted to the outer circumferential surface of the pen point 103 to retain the pen point 103 at the front end of the barrel 120. The ribs in the inner circumferential surface at the front end form air paths between the outer circumferential surface of the pen point 103 and the inner circumferential surface of the barrel 120.

The configuration of the intermediate member 105 in the present embodiment is illustrated in FIGS. 6(*a*) and 6(*b*). The intermediate member 105 is formed by injection molding of, for example, a synthetic resin (for example, polypropylene, polyethylene, etc.). An approximate center of the intermediate member 105 is an approximately disk-shaped partition wall dividing the ink absorber 104 and the ink cartridge 106. An annular stepped portion is formed in an outer circumference of the partition wall. The partition wall is fitted in the annular rib formed in the inner circumferential surface of the barrel 120.

In a front surface of the partition wall, the ink guiding portions 151 projecting forward are integrally formed. As illustrated in FIGS. 4(*a*) through 4(*c*), the ink guiding portions 151 in the present embodiment are made with two communication pipes extending axially. The ink guiding portions 151 may have a configuration made with three or more communication pipes.

In a rear surface of the partition wall, the projection 152 projecting rearward is integrally formed. As illustrated in FIG. 6(*a*), in the projection 152, two channels (grooves) 154 extending longitudinally with an approximate semicircular cross section are formed. As illustrated in FIG. 4(*a*), the two channels 154 in the projection 152 lead to respective two communication pipes of the ink guiding portions 151 via two through holes formed in the partition wall.

Such projection 152 is inserted into the opening 172 of the ink cartridge 106. At this time, the projection 152 presses rearward the plug 108 fitted in the inner circumferential surface of the opening 172 to release the fitting between the plug 108 and the opening 172. One of the channels 154 in the projection 152 acts as an ink supply path. That is, the ink in the container 107 flows into one of the communication pipes of the ink guiding portions 151 through the one channel 154. The ink having passed through the one communication pipe is absorbed by the ink absorber 104 and supplied to the pen point 103 side. The other channel 154 in the projection 152 acts as an air intake path. That is, the other channel 154 in the projection 152 becomes a path to introduce the air forced out of inside the barrel 120 as the ink flows in into the container 107. By such configuration, the other channel 154 to be the air intake path is not blocked (fluid tight condition) by the ink, and internal pressure balance between the barrel 120 and the container 107 is maintained. As a result, ink supply to the pen point 103 is carried out always stably and stable handwriting is enabled without causing scratchy handwriting.

Further, in the rear surface of the partition wall, the air tight connection portion 153 in a cylindrical shape projecting rearward is integrally formed. The opening 172 of the ink cartridge 106 is inserted into the air tight connection portion 153. The outer circumferential surface of the opening 172 is air tight fitted in the inner circumferential surface of the air tight connection portion 153. Such configuration securely prevents leakage of the ink through one of the channels 154 in the projection 152.

Here, as illustrated in FIGS. 6(*a*) and 6(*b*), the writing instrument 101 in the present embodiment has a configuration in which a small protrusion 155 as a male fitting portion is integrally formed on a rear end surface of the projection 152. The small protrusion 155 is in an elongated rod shape with a diameter (maximum diameter) less than a diameter of the projection 152 (maximum diameter). The diameter (maximum diameter) of the small protrusion 155 is less than a diameter of a plug portion 181 of the plug 108 illustrated in FIGS. 7(*b*) and 7(*c*). Further, the diameter (maximum diameter) of the small protrusion 155 is slightly less than a diameter of a small bore 183 opened in the front of the plug portion 181. Accordingly, the small protrusion 155 may be inserted into the small bore 183. As illustrated in FIG. 6(*b*), in an end portion on both side surfaces of the small protrusion 155, respective minute convex portions 155*a* (first shape) are formed. The two convex portions 155*a* are in a shape corresponding to an annular convex portion (second shape) 183*a* and an annular concave portion (second shape) 183*b* in the small bore 183 illustrated in FIG. 7(*c*).

In FIG. 6(*b*) and FIG. 7(*c*), when the small protrusion 155 is inserted into the small bore 183, the two convex portions 155*a* are fitted in the annular concave portion 183*b* over the annular convex portion 183*a* formed in the small bore 183. In such fitted state, when a force in a direction to pull out the small protrusion 155 of the small bore 183 acts, the two convex portions 155*a* release the fitting with the annular concave portion 183*b* over the annular convex portion 183*a* formed in the small bore 183. That is, the two convex portions 155*a* are capable of switching a fitted state or a fitting released state with the small bore 183 by getting over the annular convex portion 183*a*. The small protrusion 155 and the small bore 183 of such configuration are fitted in each other in a procedure of attaching the ink cartridge 106 to the writing instrument body 102 and release the fitting in each other in a procedure of detaching the ink cartridge 106 from the writing instrument body 102.

A preferred fitting force between the two convex portions 155*a* and the annular concave portion 183*b* may be set with, for example, a force required by the two convex portions 155*a* to get over the annular convex portion 183*a* (in particular, a pull-out force) at approximately 0.2 kgf. When there is a fitting force of approximately 0.2 kgf between the two convex portions 155*a* and the annular concave portion 183*b*, in the procedure of detaching the ink cartridge 106 from the writing instrument body 102 (refer to FIGS. 9(*b*) and 9(*c*)), the plug 108 may be fitted again in the opening 172 (refer to FIGS. 10(*b*) and 10(*c*)).

<<Ink Cartridge>>

As illustrated in FIG. 4(*b*), the ink cartridge 106 has a configuration provided with the container 107, the opening 172, and the plug 108.

The container 107 is in a cylindrical shape with the opened front end and the closed rear end. The container 107 is obtained by injection molding or blow molding of a synthetic resin. As a rigid resin to be a material for the container 107, a polypropylene resin, for example, may be used. In the approximate center of the outer circumferential surface of the container 107, thread ridges (male thread) 173 are integrally formed. The thread ridges 173 are screwed to the thread ridges (female thread) 121 of the barrel 120.

Inside the container 107 is the ink storage portion 171, and the ink storage portion 171 is filled with ink, not shown. In the container 107, oil based ink, for example, is stored. As the oil based ink, oil based ink for writing board containing additives, such as pigments, a resin, and a remover, using, for example, ethanol and isopropyl alcohol as a solvent is applied. The oil based ink for writing board of such composition is excellent in handwriting drying properties and erasability when being written. Ink applied to the present invention is not limited to the composition of the oil based ink for writing board and may be oil based ink not containing a remover or water based ink containing water as a main solvent.

To the front end side of the container 107, the opening 172 as a component separate from the container 107 is attached. The opening 172 is blocked from inside by the plug 108. The plug 108 blocks the opening 172 from inside before the ink cartridge 106 is attached to the writing instrument body 102 and when the ink cartridge 106 is detached from the writing instrument body 102. Specifically, in the fitting released state of the small protrusion 155 and the small bore 183 described above, the plug 108 blocks the opening 172 from inside. In the fitted state of the small protrusion 155 and the small bore 183 described above, the plug 108 releases the blocking of the opening 172. The configuration of the plug 108 and the opening 172 are described below with reference to FIGS. 7(*a*) through 7(*c*) and FIGS. 10(*a*) through 10(*c*).

In FIGS. 7(*a*) through 7(*c*), the plug 108 in the present embodiment has a configuration in which an ink intake portion 182 is integrally formed in the rear of the plug portion 181. The plug portion 181 is in a bottomed cylindrical shape. Inside the plug portion 181, the small bore 183 described above is formed. The small bore 183 is opened in the front of the plug portion 181. The small bore 183 is a female fitting portion paired up with the small protrusion 155 of the intermediate member 105 described above. As illustrated in FIG. 7(*c*), in an inner circumferential surface of the small bore 183, the annular convex portion 183*a* and the annular concave portion 183*b* are formed continuously in front and rear. As described above, the annular convex portion 183*a* and the annular concave portion 183*b* are in a shape corresponding to the two convex portions 155*a* of the small protrusion 155 illustrated in FIG. 6(*b*).

Figure 10:
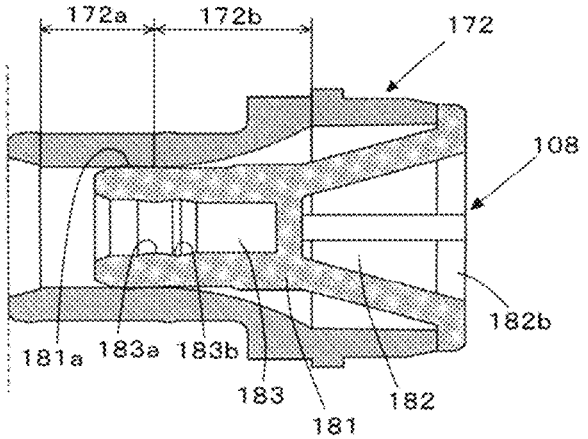
FIG. 10(*a*) is a cross-sectional view illustrating a fitted state of an opening and a plug of an ink cartridge before attached to a writing instrument body.
Figure 10:
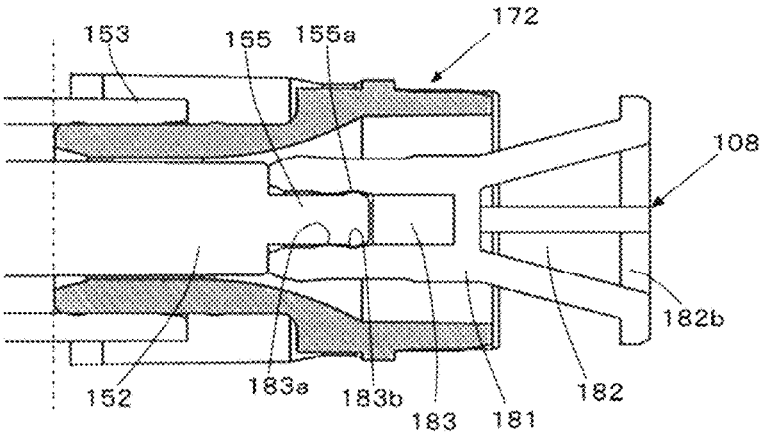
Figure 10:
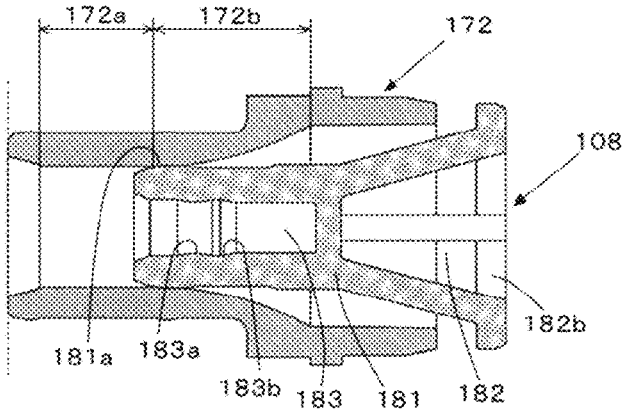

As illustrated in FIGS. 7(*a*) through 7(*c*), on a front end side of an outer circumferential surface of the plug portion 181, an annular bulge 181*a* is integrally formed. As illustrated in FIGS. 10(*a*) and 10(*c*), the plug portion 181 is fitted in the opening 172 from inside. At this time, the annular bulge 181*a* formed on the outer circumferential surface of the plug portion 181 is pressure fitted to the inner circumferential surface of the opening 172. The opening 172 is thus air tight blocked and leakage of the ink stored in the ink storage portion 171 is prevented.

Here, as illustrated in FIGS. 10(*a*) and 10(*c*), in the present embodiment, the inner circumferential surface of the opening 172 has a configuration of continuous surfaces in two types of different shapes in front and rear. That is, the inner circumferential surface of the opening 172 is configured with a cylindrical inner circumferential surface 172*a* and a tapered inner circumferential surface 172*b* that are continuous in front and rear. The cylindrical inner circumferential surface 172*a* is an inner circumferential surface in a cylindrical shape with an equal diameter longitudinally. The tapered inner circumferential surface 172*b* is an inner circumferential surface in a tapered shape with a rearwardly increasing diameter. The tapered inner circumferential surface 172*b* has a decreasing diameter from the rear to the front and is finally continued to the cylindrical inner circumferential surface 172*a*. By such configuration, the tapered inner circumferential surface 172*b* exhibits a function of guiding a front end of the plug portion 181 to the cylindrical inner circumferential surface 172*a*.

As illustrated in FIGS. 7(*a*) through 7(*c*), the ink intake portion 182 is integrally formed in the rear of the plug portion 181. The ink intake portion 182 is configured with four rod-like members 182*a* and an annular member 182*b*. Each rod-like member 182*a* has a front end connected to a rear end surface of the plug portion 181. Each rod-like member 182*a* has a rear end radiated rearwardly and respectively connected to an internal surface of the annular member 182*b*. The ink in the ink storage portion 171 flows to the opening 172 side through intervals 182*c* formed by two of the rod-like members 182*a* that are adjacent to each other.

Figure 5:
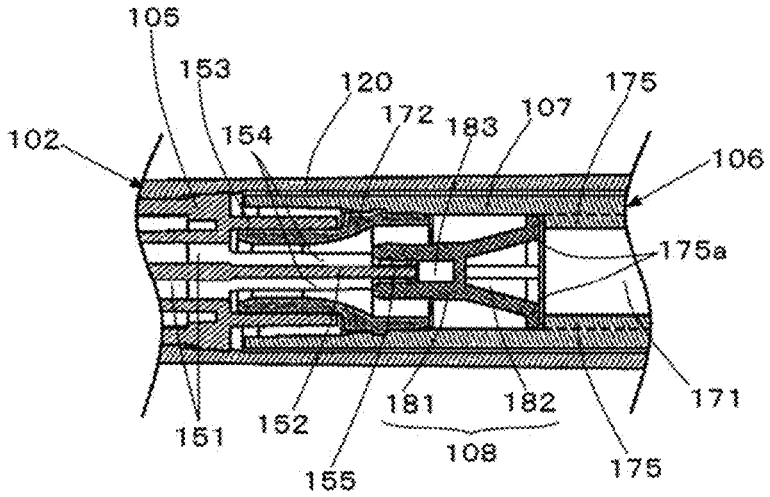
FIG. 5(*a*) is an enlarged cross-sectional view of an area of coupling the ink cartridge to the writing instrument body, constituting the writing instrument in FIG. 4(*a*).
Figure 5B:
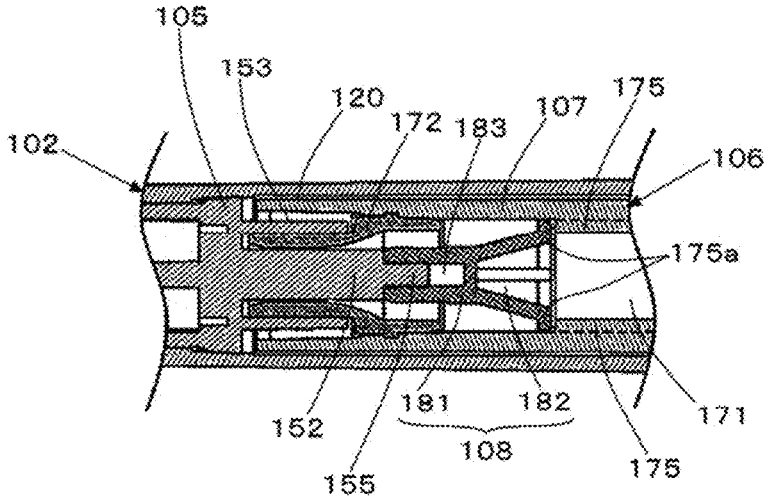

Here, as illustrated in FIGS. 5(*a*) and 5(*b*), the annular member 182*b* has an outer diameter in dimensions approximately same as an inner diameter of the ink storage portion 171. Meanwhile, in an inner wall of the container 107, a plurality of ribs 175 projecting into the ink storage portion 171 are formed at regular interval. Front end surfaces (abutting portions) 175*a* of the ribs 175 abut against the annular member 182*b* to restrict rearward movement of the plug 108. This prevents the plug 108 from moving into the ink storage portion 171.

Further, as illustrated in FIG. 10(*b*), the present embodiment has a configuration in which, when the rear end surface of the projection 152 abuts against a front end surface of the plug portion 181, the two convex portions 155*a* formed in the small protrusion 155 are fitted in the annular concave portion 183*b* over the annular convex portion 183*a* formed in the small bore 183. Such configuration enables, in a state of restricting rearward movement of the plug 108 by the front end surfaces 175*a* of the ribs 175, secure fitting of the small protrusion 155 and the small bore 183. That is, by inserting the small protrusion 155 into the small bore 183 of the plug 108 where the rearward movement is limited to the position of the base (that is, a position of the rear end surface of the projection 152), the two convex portions 155*a* formed in the small protrusion 155 are securely fitted in the annular concave portion 183*b* over the annular convex portion 183*a* formed in the small bore 183.

<<Attachment of Ink Cartridge>>

Then, a procedure of attaching the ink cartridge 106 to the writing instrument body 102 is described with reference to FIGS. 8(*a*) through 8(*e*) and FIGS. 10(*a*) and 10(*b*).

As illustrated in FIG. 8(*a*), the writing instrument body 102 and the ink cartridge 106 are in a state of separated from each other. The ink cartridge 106 illustrated in FIG. 8(*a*) is in an unused state as shipped from a factory. FIG. 10(*a*) illustrates the fitted state of the opening 172 and the plug 108 in the ink cartridge 106 in an unused state. In FIG. 10(*a*), in the ink cartridge 106 in an unused state, the annular member 182*b* of the plug 108 abuts against a rear end edge of the opening 172. This means that the plug portion 181 of the plug 108 is fitted in the cylindrical inner circumferential surface 172*a* as deep as possible. By such robust fitting of the plug portion 181 and the cylindrical inner circumferential surface 172*a*, in the course of commercial distribution, the ink cartridge 106 in an unused state does not cause ink leakage.

Subsequently, as illustrated in FIG. 8(*b*), the ink cartridge 106 is inserted into the rear end opened area of the barrel 120 of the writing instrument body 102. Then, the ink cartridge 106 is rotated relative to the barrel 120 to screw the thread ridges 173 of the ink cartridge 106 and the thread ridges 121 of the barrel 120. As described above, the plug 108 is robustly fitted inside the opening 172 and is positioned on the axial center of the ink cartridge 106. Then, by screwing the two thread ridges 173 and 121, the axial center of the writing instrument body 102 roughly matches the axial center of the ink cartridge 106. The small protrusion 155 formed in the projection 152 and the small bore 183 formed in the plug portion 181 are thus positioned on the identical axial center. Then, with the progress of the screwing of the two thread ridges 173 and 121, the distance between the small protrusion 155 and the small bore 183 is reduced.

Subsequently, as illustrated in FIG. 8(*c*), with the further progress of the screwing of the two thread ridges 173 and 121, the small protrusion 155 is inserted into the small bore 183 to the position of the base. The two convex portions 155*a* formed in the small protrusion 155 are thus fitted in the annular concave portion 183*b* over the annular convex portion 183*a* formed in the small bore 183. At this time, inside the opening 172, a rear end side of the projection 152 is inserted shallowly.

Subsequently, as illustrated in FIG. 8(*d*), with the further progress of the screwing of the two thread ridges 173 and 121, the rear end surface of the projection 152 presses rearward the front end surface of the plug 108 (plug portion 181). The plug 108 is thus moved rearward, and the fitting between the outer circumferential surface of the plug portion 181 and the cylindrical inner circumferential surface 172*a* of the opening 172 is released (refer to FIG. 10(*b*)). At this time, inside the opening 172, half or more of the projection 152 is inserted. The front end side of the opening 172 is shallowly inserted inside the air tight connection portion 153.

Then, as illustrated in FIG. 8(*e*), when the screwing of the two thread ridges 173 and 121 is completed, the projection 152 is completely inserted inside the opening 172, and the annular member 182*b* of the plug 108 (ink intake portion 182) abuts against the front end surfaces 175*a* of the ribs 175. The fitted state of the small protrusion 155 and the small bore 183 is thus maintained. Even when the fitted state of the small protrusion 155 and the small bore 183 is released in a procedure from FIG. 8(*c*) to FIG. 8(*d*) or a procedure from FIG. 8(*d*) to FIG. 8(*e*), the small protrusion 155 and the small bore 183 are again in the fitted state by abutting the annular member 182*b* of the plug 108 against the front end surfaces 175*a* of the ribs 175. As illustrated in FIG. 8(*e*), the front end side of the opening 172 is completely inserted inside the air tight connection portion 153, and the outer circumferential surface of the opening 172 air tight fits in the inner circumferential surface of the air tight connection portion 153. The attachment of the ink cartridge 106 to the writing instrument body 102 is thus completed.

In FIG. 8(*e*), the ink stored in the ink storage portion 171 of the ink cartridge 106 flows in the direction of the opening 172 through the ink intake portion 182 of the plug 108. The ink flowed in the direction of the opening 172 flows into one of the communication pipes of the ink guiding portions 151 through one of the channels 154 formed in the projection 152. The ink having passed through the one communication pipe is absorbed by the ink absorber 104 and supplied to the pen point 103 side. As the ink flows in, the air in the barrel 120 side is introduced into the ink storage portion 171 through the other channel 154 formed in the projection 152.

That is, in the writing instrument 101 in the present embodiment, immediately after the attachment of the ink cartridge 106 to the writing instrument body 102 is completed, the ink in the ink storage portion 171 and the air in the barrel 120 are replaced smoothly. After that, the other channel 154 as an air intake path is not blocked (fluid tight condition) by the ink. The internal pressure balance between the barrel 120 and the container 107 is thus maintained. As a result, ink supply to the pen point 103 is carried out always stably and stable handwriting is enabled without causing scratchy handwriting.

<<Detachment of Ink Cartridge>>

Then, a procedure of detaching the ink cartridge 106 from the writing instrument body 102 is described with reference to FIG. 9(*a*) through (*d*) and FIGS. 10(*b*) and 10(*c*).

Figure 9:
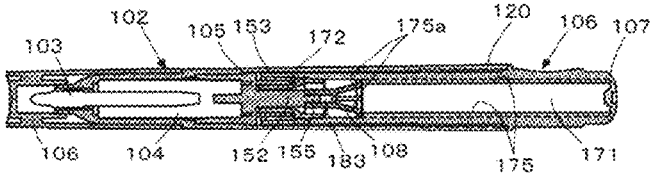
FIG. 9(*a*) through (*d*) are cross-sectional views illustrating a procedure of detaching an ink cartridge from a writing instrument body.
Figure 9:
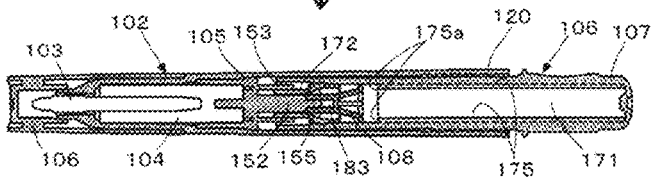
Figure 9:
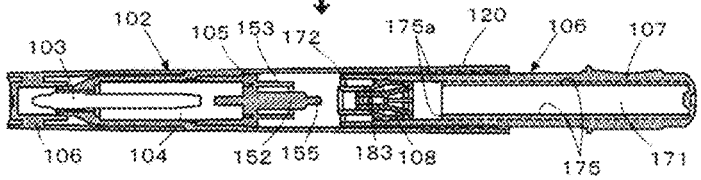
Figure 9:
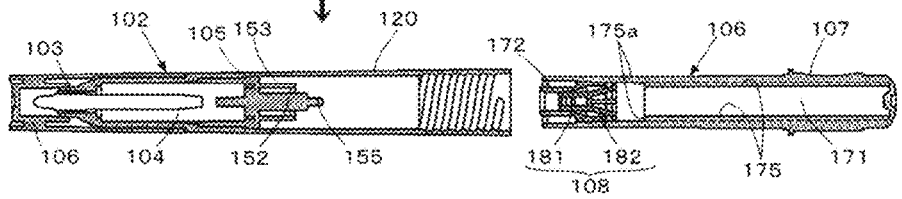

FIG. 9(*a*) illustrates a state of the writing instrument 101 identical to that in FIG. 8(*e*). The ink in the ink cartridge 106 illustrated in FIG. 9(*a*) is assumed to be used by a user. In FIG. 9(*a*), for replacement of the ink cartridge 106 that is used, the ink cartridge 106 is rotated relative to the barrel 120 in a direction opposite to the case of FIGS. 8(*a*) through 8(*e*) to release the screwing of the two thread ridges 173 and 121.

Subsequently, as illustrated in FIG. 9(*b*), with the progress of releasing the screwing of the two thread ridges 173 and 121, the opening 172, together with the ink cartridge 106, moves in the rear of the barrel 120. The projection 152 is thus gradually pulled out of inside the opening 172. At this time, as illustrated in FIG. 10(*b*), the front end side of the plug 108 (plug portion 181) fitted in the small protrusion 155 is guided by the tapered inner circumferential surface 172*b* of the opening 172 to be led to the cylindrical inner circumferential surface 172*a*. As illustrated in FIG. 9(*b*), with the progress of releasing the screwing of the two thread ridges 173 and 121, the front end side of the opening 172 is also gradually pulled out of inside the air tight connection portion 153.

Subsequently, with the further progress of releasing the screwing of the two thread ridges 173 and 121, the bulge 181*a* formed on the front end side of the plug portion 181 is fitted in the vicinity of a border between the tapered inner circumferential surface 172*b* and the cylindrical inner circumferential surface 172*a* of the opening 172 (refer to FIG. 10(*c*)). Subsequently, as illustrated in FIG. 9(*c*), with the further progress of releasing the screwing of the two thread ridges 173 and 121, the two convex portions 155*a* formed in the small protrusion 155 release the fitting with the annular concave portion 183*b* over the annular convex portion 183*a* formed in the small bore 183. At this time, the projection 152 is completely pulled out of inside the opening 172. The front end side of the opening 172 is also completely pulled out of inside the air tight connection portion 153.

Then, as illustrated in FIG. 9(*d*), when the releasing of the screwing of the two thread ridges 173 and 121 is completed, the used ink cartridge 106 is detached from the rear end opened area of the barrel 120 the writing instrument body 102. As illustrated in FIG. 10(*c*), the opening 172 of the ink cartridge 106 detached from the writing instrument body 102 is blocked again from inside by the plug 108. This enables more secure prevention of inappropriate leakage of the ink remained in the ink storage portion 171.

Here, the fitting force at this stage of the plug 108 illustrated in FIG. 10(*c*) does not have to be the robust fitting force at the time of shipment illustrated in FIG. 10(*a*). The fitting force at this stage of the plug 108 illustrated in FIG. 10(*c*) may be at least a fitting force sufficient for blocking the opening 172 only in a period short until a user disposes of the used ink cartridge 106.

The fitting force (pull-out force) between the plug 108 and the opening 172 at the time of shipment of the ink cartridge 106 illustrated in FIG. 10(*a*) may be set at, for example, approximately 1.2 kgf. When there is a fitting force of approximately 1.2 kgf, it is possible to prevent releasing of the fitting between the plug 108 and the opening 172 by vibrations and impacts from outside. Meanwhile, the fitting force at this stage (pull-out force) of the plug 108 illustrated in FIG. 10(*c*) may be, for example, approximately 0.03 kgf. Although the fitting force of approximately 0.03 kgf is a very small force, it is sufficient for blocking the opening 172 only in a short period until a user disposes of the used ink cartridge 106.

<<Action and Effect>>

The writing instrument 101 described above in the present embodiment has a configuration provided with a male fitting portion and a female fitting portion to retain the plug 108 with the projection 152 separately from the projection 152 and the opening 172. Such configuration enables the writing instrument 101 to retain the plug 108 with the projection 152 until the ink cartridge 106 is detached from the writing instrument body 102. As a result, in the procedure of detaching the ink cartridge 106 from the writing instrument body 102, the writing instrument 101 is capable of securely fitting the plug 108 inside the opening 172. Accordingly, when the ink cartridge 106 is replaced, it is possible to more securely prevent inappropriate leakage of the ink remained in the ink storage portion 171.

The writing instrument 101 described above in the present embodiment has a configuration in which a male fitting portion is the small protrusion 155 and a female fitting portion is the small bore 183. In addition, the writing instrument 101 employs a configuration in which the two convex portions 155*a* formed in the small protrusion 155 are fitted in the annular concave portion 183*b* over the annular convex portion 183*a* formed in the small bore 183. The two convex portions 155*a* are capable of switching a fitted state or a fitting released state with the small bore 183 by getting over the annular convex portion 183*a*. According to such configuration, the small protrusion 155 may be securely fitted in the small bore 183 of the plug 108 where the movement is limited in the ink cartridge 106. Utilizing a tensile force when fitting between the plug 108 and the small bore 183 is released, the plug 108 may be securely fitted inside the opening 172.

The writing instrument 101 described above in the present embodiment has a configuration provided with the plug 108 including the plug portion 181 and the ink intake portion 182. The plug portion 181 has a function of blocking the opening 172. The ink intake portion 182 has a function of allowing ink to flow therethrough. The front of the plug 108 has a function of blocking the opening 172 and the rear, which does not affect the blocking of the plug 108, has a function of allowing ink to flow therethrough, resulting in the plug 108 being more efficient and functional. As a result, the degree of freedom in design of the opening 172 and the intermediate member 105 increases.

The writing instrument 101 described above in the present embodiment has the inner circumferential surface of the opening 172 configured with the cylindrical inner circumferential surface 172*a* with an identical diameter and the tapered inner circumferential surface 172*b* with a rearwardly increasing diameter. According to such configuration, the front end side of the plug 108 fitted in the small protrusion 155 is guided by the tapered inner circumferential surface 172*b* of the opening 172. The bulge 181*a* formed on the front end side of the plug 108 is thus easily fitted in the vicinity of the border between the tapered inner circumferential surface 172*b* and the cylindrical inner circumferential surface 172*a*.

More Preferred Embodiment

In the writing instrument 101 described above in the second embodiment, the thickness of the barrel 120 of the writing instrument body 102 is not particularly limited. However, preferably, when the barrel 120 is in a cylindrical shape with an outer diameter of approximately 14 mm, an external form is obtained that is easily held by hand of average size. In particular, when the writing instrument 101 is a board marker, the barrel 120 in a cylindrical shape having an outer diameter of approximately 14 mm facilitates writing on a board in an upright state.

Then, when the barrel 120 is in a cylindrical shape having an outer diameter of approximately 14 mm, the container 107 of the ink cartridge 106 may be in a cylindrical shape having an outer diameter of 12 mm or less preferably approximately 11 mm. When the container 107 has an outer diameter of 12 mm or less, the entire writing instrument body 102 has a slim outer diameter of approximately 14 mm or less and also both the wall portion constituting the rear end opened area of the barrel and the wall portion of the front end side of the container 107 inserted thereto may have a thickness required to secure the strength.

Further, when the container 107 has an outer diameter on of 12 mm or less, the opening 172 preferably has an inner diameter within a range from 3 to 8 mm. By providing the opening 172 with an inner diameter within a range from 3 to 8 mm, any one of the outer circumferential surface or the inner circumferential surface of the air tight connection portion 153 in a cylindrical shape provided in the barrel 120 with an outer diameter of approximately 14 mm may be fitted in any one of the inner circumferential surface or the outer circumferential surface of the opening 172.

Third Embodiment

The third embodiment of a writing instrument of the present invention is described with reference to FIGS. 11(*a*) through 11(*c*). The present invention is not limited to the embodiments described below.

<<Entire Configuration of Writing Instrument>>

Figure 11:
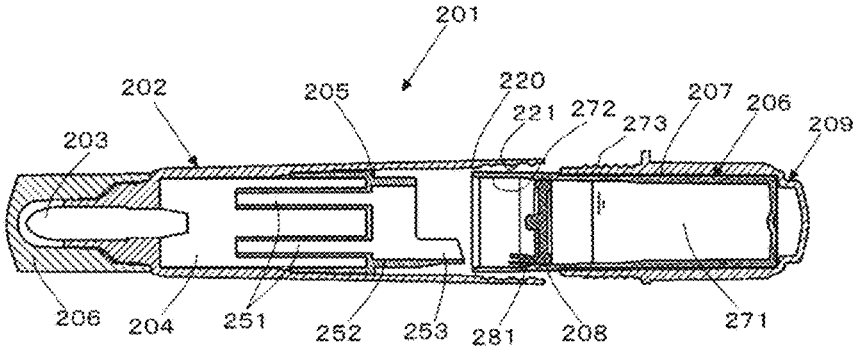
FIG. 11(*a*) is a cross-sectional view illustrating a writing instrument according to a third embodiment of the present invention.
Figure 11:
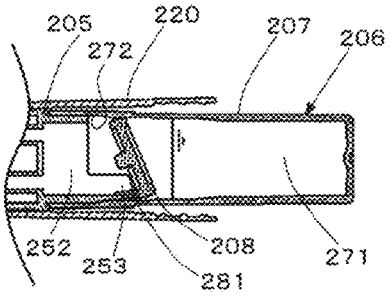
Figure 11:
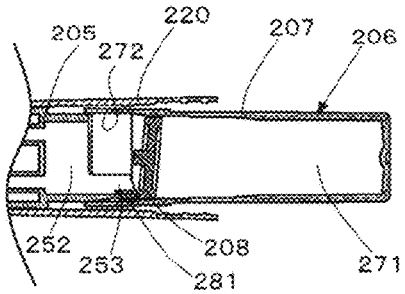

A writing instrument 201 of the third embodiment illustrated in FIG. 11(*a*) is configured with a writing instrument body 202, an ink cartridge 206, and an end plug 209. The writing instrument body 202 is provided with a barrel 220. The barrel 220 is an approximately cylindrical resin molding with an open rear end. In the front end of the barrel 220, a pen point 203 to be a writing tip end is installed. In the rear of the pen point 203 in the barrel 220, an ink absorber 204 is built. To the rear of the ink absorber 204 in the barrel 220, an intermediate member 205 is attached. In a tip end side of the writing instrument body 202, a cap 206 is installed.

The ink cartridge 206 is provided with a cylindrical container 207 with an opened front end and a closed rear end. In an ink storage portion 271 of the container 207, ink is directly stored. At the front end of the container 207, an opening 272 is opened. The opening 272 of the ink cartridge 206 before attached to the writing instrument body 202 is blocked by a plug 208 in a plate shape from inside.

The writing instrument 201 is a writing instrument of a direct fluid type in which the ink stored in the ink storage portion 271 of the container 207 is supplied straight to the ink absorber 204 in the barrel 220 via the intermediate member 205. In the rear of the intermediate member 205, a projection (ink-guiding tube) 252 connected to the opening 272 of the container 207 is integrally formed. In the front of the intermediate member 205, ink guiding portions 251 to be communication pipes are integrally formed.

An inner circumferential surface at the rear end of the barrel 220 is provided with thread ridges (female thread) 221. Meanwhile, a front end side of the end plug 209 is provided with thread ridges (male thread) 273. The ink cartridge 206 is inserted into a rear end opened area of the barrel 220 and the thread ridges 221 of the barrel 220 and the thread ridges 273 of the end plug 209 are screwed together, thereby forming a mode of writing instrument. The ink cartridge 206 inserted into the rear end opened area of the barrel 220 is covered with the end plug 209. When the end plug 209 is formed with a translucent material, ink color and an amount of residual ink filled in the ink cartridge 206 become visually recognizable.

Here, with the projection 252 in the present embodiment, a pressing piece 253 in a lancet shape partially projecting from a periphery of the tubular wall portion is integrally formed. Meanwhile, with the plug 208 in the present embodiment, a clamping piece 281 projecting forward from a peripheral portion in a plate shape is integrally formed. The clamping piece 281 has a configuration in which two thin wall portions made of a synthetic resin are arranged facing each other. In between the clamping piece 281, a tip end portion of the pressing piece 253 is thrust, and the pressing piece 253 and the clamping piece 281 are in a fitted state. Such pressing piece 253 and clamping piece 281 constitute a male fitting portion and a female fitting portion to retain the plug 208 of the ink cartridge 206 with the projection 252.

<<Attachement of Ink Cartridge>>

As illustrated in FIG. 11(*b*), when the rear end opened area of the barrel 220 of the writing instrument body 202 is pushed into the ink cartridge 206, the projection 252 of the intermediate member 205 is inserted into the opening 272. At this time, the tip end portion of the pressing piece 253 is thrust in between the clamping piece 281, and the pressing piece 253 and the clamping piece 281 are in the fitted state. Then, when the ink cartridge 206 is further pushed forward, the projection 252 is completely inserted into the opening 272 and an outer circumferential surface of the projection is air tight fitted in an inner circumferential surface of the opening 272. At this time, while keeping the fitted state with the clamping piece 281, the pressing piece 253 presses one side of the plug 208 rearward to turn the plug 208 rearward. The fitting between the plug 208 and the opening 272 is thus released The ink stored in the ink storage portion 271 of the ink cartridge 206 flows into the projection 252 to be an ink-guiding tube through a gap between the plug 208 and the opening 272. Then, the ink flows into the ink guiding portions 251 to be communication pipes through the projection 252. The ink flowed through the ink guiding portions 251 is absorbed by the ink absorber 204 and supplied to the pen point 203 side.

<<Detachment of Ink Cartridge>>

As illustrated in FIG. 11(*c*), when the ink cartridge 206 that is used is pulled out of the rear end opened area of the barrel 220 of the writing instrument body 202, the fitted state between the projection 252 and the opening 272 is released. At this time, the pressing piece 253 fitted in the clamping piece 281 draws one side of the plug 208 forward to turn the plug 208 forward. The peripheral portion of the plug 208 is fitted again in the inner circumferential surface of the opening 272. Then, when the ink cartridge 206 is pulled out further rearward, the fitted state of the pressing piece 253 and the clamping piece 281 is released. The used ink cartridge 206 is thus detached from the rear end opened area of the barrel 220 of the writing instrument body 202. The opening 272 of the ink cartridge 206 thus detached from the writing instrument body 202 is blocked again from inside by the plug 208.

<<Action and Effect>>

The writing instrument 201 described above in the present embodiment has a configuration provided with a male fitting portion and a female fitting portion to retain the plug 208 with the projection 252 separately from the projection 252 and the opening 272. Such configuration enables the writing instrument 201 to retain the plug 208 with the projection 252 until the ink cartridge 206 is detached from the writing instrument body 202. As a result, in the procedure of detaching the ink cartridge 206 from the writing instrument body 202, the writing instrument 201 is capable of securely fitting the plug 208 inside the opening 272. Accordingly, when the ink cartridge 206 is replaced, inappropriate leakage of the ink remained in the ink storage portion 271 may be prevented more securely.

The writing instrument 101 described above in the present embodiment has a configuration in which a male fitting portion is the pressing piece 253 and a female fitting portion is the clamping piece 281. The clamping piece 281 is capable of clamping the tip end portion of the pressing piece 253 between the two thin wall portions made of a synthetic resin. The clamping piece 281 has flexibility following the turning of the plug 208 and is capable of maintaining the fitted state with the pressing piece 253 until the ink cartridge 206 is detached from the writing instrument body 201. Accordingly, utilizing the tensile force when the cartridge 206 is pulled out, the plug 208 may be securely fitted inside the opening 272.

Fourth Embodiment

Descriptions are given to an embodiment of a writing instrument of the present invention with reference to the drawings while the present invention is not limited to them.

Figure 12:
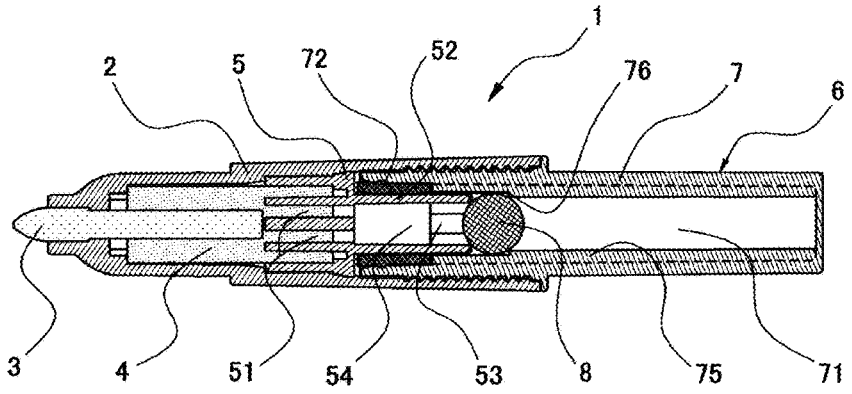
FIG. 12 is a cross-sectional view illustrating a writing instrument according to a fourth embodiment of the present invention.
Figure 13:
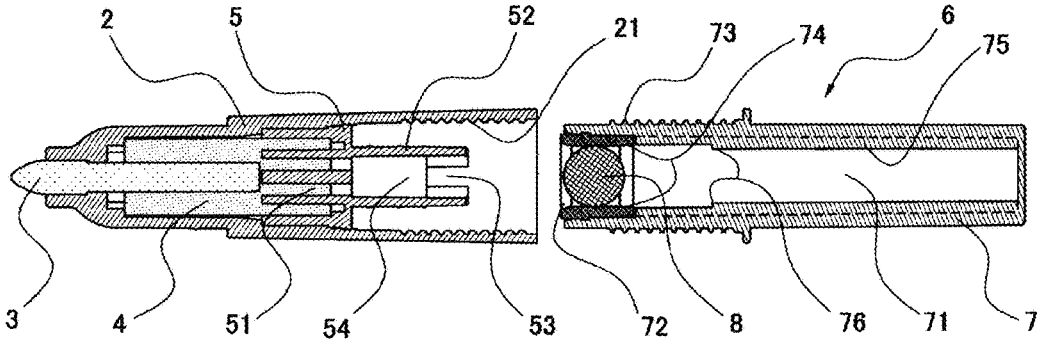
FIG. 13 is a cross-sectional view illustrating a cartridge separated state (before use) of the writing instrument in FIG. 12.
Figure 14:
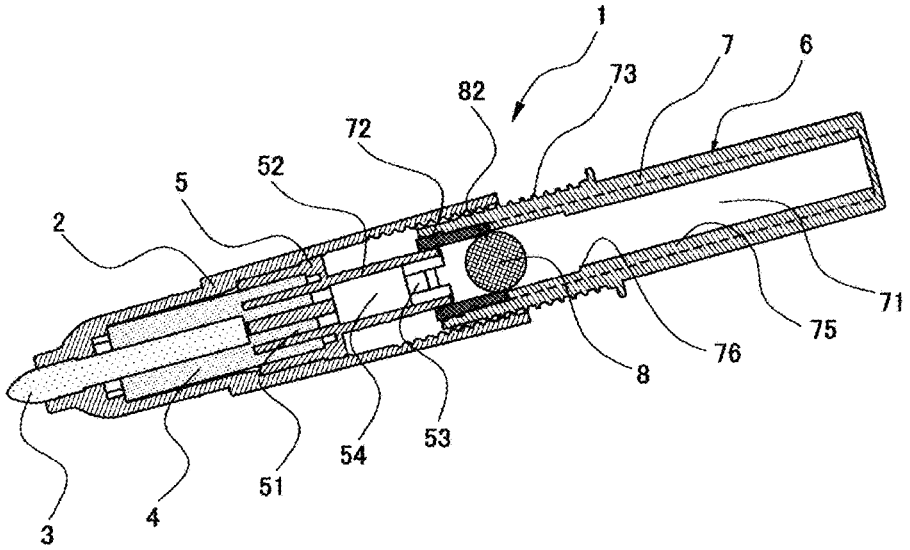
FIG. 14 is a cross-sectional view of the writing instrument in FIG. 12 illustrating a disengaged state when the cartridge is replaced.

A writing instrument 1 of an embodiment illustrated in FIGS. 12 through 14 is a capped writing instrument (a cap is not shown) configured with a writing instrument body that is provided with a pen point 3 to be a writing tip end at a barrel 2 front end and that has an ink absorber 4 and an intermediate member 5 disposed in the barrel 2 and an ink cartridge 6 that directly stores ink in a bottomed cylindrical container 7 and that blocks an opening 72 thereof by a plug 8.

The writing instrument 1 is a writing instrument of a direct fluid type having the barrel 2 (an approximately cylindrical resin molding in a rear end opened shape retaining the pen point 3 at a front end and having the ink absorber 4 and the intermediate member 5 built therein), as a writing instrument body, that is provided with the pen point 3, the ink absorber 4 connected to a rear end of the pen point 3, and the intermediate member 5 arranged in the rear of the ink absorber 4 (provided with communication pipes 51 for ink guidance in the front and a projection 52 for connection in the rear). Further, the ink cartridge 6 is inserted from the rear end opened area of the barrel 2 and is air tight fitted in the projection 52 while being screwed to the barrel 2, thereby making a writing instrument form.

The pen point 3 is a rod-like marking pen tip obtained by resin treatment of synthetic resin fiber (for example, polyester fiber, acrylic fiber, nylon fiber, etc.). Although a front end of the pen point 3 is ground in a bullet shape, those processed in a general purpose shape, such as a chisel shape, are applicable. Further, other than a marking pen tip, it is also possible to use a ballpoint pen tip and the like.

The ink absorber 4 is made with a columnar processed object of synthetic resin fiber (for example, polyester fiber). The outer circumferential surface of the ink absorber 4 is covered with a cylindrical outer skin. The outer skin is made with a film of a synthetic resin (for example, a film of polyethylene terephthalate). A rear end of the pen point 3 hits and is inserted into the axial center of a front end surface of the ink absorber 4, and the rear end of the pen point 3 is positioned in the front of inside the ink absorber 4.

For the ink absorber, those for general purpose may be used as long as it has a structure that is capable of temporarily retaining ink, and it is also possible to use an accordion-like ink holding member (pen core) and the like.

The barrel 2 is a tubular object obtained by injection molding of a synthetic resin (for example, polypropylene, polyethylene, etc.) and has a tapered front end retaining a pen point outer circumferential surface and is molded in one member through a rear end opening area. Further, the ink absorber 4 and the intermediate member 5 (and further, an ink cartridge 6 front side in a connected state) are disposed inside and thread ridges 21 (female thread) to which the cartridge 6 is screwed are formed in the rear. In a position where the intermediate member 5 is disposed, an annular rib is formed to have a structure fit retaining the intermediate member 5 in a specific position.

As a specific structure, a plurality of ribs extending longitudinally are integrally formed in an internal surface of the barrel 2 and the outer circumferential surface of the ink absorber 4 is pressure fit retained by the ribs. A rib is also formed in an internal surface of the tapered portion to pressure fit retain an outer circumferential surface of the pen point 3.

By the ribs, air paths are formed between the outer circumferential surface of the ink absorber 4 and the internal surface of the barrel 2 and between the outer circumferential surface of the pen point 3 and the internal surface of the tapered portion.

The intermediate member 5 is obtained by injection molding of a synthetic resin (for example, polypropylene, polyethylene, etc.). The intermediate member 5 is made with one member provided with an approximately disk-shaped partition wall dividing the ink absorber 4 and the ink cartridge 6, a plurality (specifically, two) of communication pipes (axially provided with ink guiding portions 51) projecting forward from a front surface of the partition wall and hitting and connected inside the ink absorber 4, and a cylindrical projection (ink-guiding tube) 52 projecting rearward from a rear surface of the partition wall and air tight connected by being inserted into a front end opening of the ink cartridge 6. Therefore, when being written, cartridge ink flowed into the projection 52 is supplied to the pen point through the ink guiding portions 51. An annular stepped portion is formed in an outer circumference of the partition wall to be fixed by being fitted in the internal surface (annular rib) of the barrel 2.

A rear end of the projection 52 presses the plug 8 rearward when the cartridge is connected and has a structure of retaining (clamping) the plug 8 near the opening with the projection 52 and a part of a container inner wall by, in a writing state, maintaining a state of approximately making contact with the plug 8. The state of approximately making contact includes a state of slight movement due to the difference in dimensions.

Therefore, when the ink cartridge 6 is pulled out in a position where the opening 72 is oriented downward for replacement of the cartridge, the plug 8 retained near the opening moves the minimum distance to the opening 72 by following the projection 52 and is capable of blocking the opening 72 again. By instantaneously blocking the opening 72, even when there is residual ink in the container, inappropriate ink leakage does not easily occur when the cartridge is replaced.

Since movement of the plug 8 is restricted when being written (in use), a noise due to the movement of the plug 8 does not occur, and further the plug 8 in a free state is not accelerated while falling or during strong shock, so that deformation of a component, lifting (disengagement) of the cartridge, and the like due to the impact hitting may be prevented to be excellent for long-term use.

Further, in order to allow the ink in the cartridge to be securely flowed into the projection 52 (channel 54) even in a state where the rear end area makes contact with the plug 8, a wall of the cylinder (projection rear end) is provided with notches (specifically, in two facing spots), and the notches act as an ink intake portion 53. In the present embodiment, by providing the notches, the projection rear end is capable of deflecting when the cartridge is connected to absorb a dimensional error in manufacturing for higher assembly efficiency.

The ink intake portion 53 may be a through hole formed in the wall of the cylinder other than the notches described above.

The projection 52 in the present embodiment is one member that serves both as a pressing plug-opening portion and an air tight connection portion and thus has a structure of forming an air tight state with an opening inner circumferential surface of the cartridge 6 by forming an annular rib in the outer circumferential surface, whereas it may be surface contact or it is also possible to separately provide an air tight connection portion. In that case, by forming an annular rib in the outer circumferential surface near the opening of the ink cartridge 6, it is also possible to use other structures that do not cause ink leakage, such as a structure of retaining the connection of the outer circumferential surface of the ink cartridge 6 (opening 72) in an air tight state and a structure of forming an air tight state with the opened front surface of the cartridge 6 and the partition wall of the intermediate member 5. In the structure of retaining the connection of the outer circumferential surface of the ink cartridge 6 (opening 72) in an air tight state by separately providing an air tight connection portion, those having an air tight connection portion a cylindrical member (inside becomes a channel 54) with the projection 52 formed in an approximate center, for example, are applicable and further those having the projection 52 in a shape splitting the channel 54 into an ink guiding path and an air intake path are applicable.

The ink cartridge 6 is a bottomed cylindrical object with an opened front end and a closed rear end and obtained by injection molding or blow molding of a synthetic resin (specifically, a polypropylene resin) in such a manner that thread ridges 73 for screw fitting (male thread) are integrally formed in an opening side outer surface. The plug 8 is fitted into an inner wall of a front opened area (opening 72) of the container.

Inside the container 7 is applied as an ink storage portion 71 to directly store oil based ink (the ink is not shown), and the opening 72 obtained by fitting a separate member is formed in the front of in order to tightly seal the inner circumferential surface by the plug 8 in a spherical shape. Near the opening (in the present embodiment, a rear end area 74 of the separate member) is formed in a tapered shape widened rearwardly and has a structure where the plug 8 moves without being caught in the opening side when the cartridge is replaced and the opening 72 is easily blocked in a taper front position.

Further, a plurality of longitudinal ribs 75 are formed in the inner wall of the container 7 at regular interval for smooth movement of the ink in the container, and a stepped portion 76 obtained by lowering the height on the opening side of each rib 75 restricts downward movement of the plug 8. Therefore, it may be near the opening without causing the plug 8 to settle down to a container bottom surface to allow immediate blocking of the opening 72 when the cartridge 6 is disengaged with the opening oriented downward.

The stepped portion 76 may be an annular rib or a partial bump formed in the container inner wall, a rod-like object extended from the bottom surface, or the like and is not limited to the above structure as long as the structure is capable of suppressing movement of the plug 8 to the bottom surface side, and it may be used regardless of integrity or separation from the container. The stepped portion 76 may also be an end portion of the opening 72 by shortening the dimensions of each rib 75.

The plug 8 is a spherical object made of metal and tightly seals an opened inner circumferential surface when not in use (FIG. 13), and when in use (FIG. 12), is pressed rearward by the rear end of the projection 52 to open the plug and be retained against the stepped portion 76. It moves forward by following the projection 52 when the cartridge is replaced with the opening oriented downward to be locked in near the opening to be in a blocking state (FIG. 14). The blocking position in the present embodiment is a taper 74 in the cartridge opening and may be securely locked and block by moving the position in front and rear in the taper in accordance with the moving speed.

Since the plug 8 moves by its own weight, it is preferred to be constituted by a material having the specific gravity greater than the ink, and in particular, metal is more preferred than a resin from the perspective of the high sphere moldability. The plug 8 may be, other than a spherical shape, in a conventionally known form, such as a disk shape, a truncated cone, a stepped cup shape, and a thin shape integrally formed with the opening 72, as long as it may be press opened and moved with the opening oriented downward.

The ink cartridge 6 is configured to have, when connected to the writing instrument body (projection 52), the rear end of the container 7 as an end plug for the writing instrument 1 by screwing the thread ridges 73 in the outer circumferential surface of the container to the thread ridges 21 of the barrel 2. Although the container outer circumferential surface of the ink cartridge 6 is connected by being screwed to the writing instrument body (barrel 2) in the present embodiment, a connection method, such as fitting, may also be used.

As the oil based ink, oil based ink for writing board containing additives, such as pigments, a resin, and a remover, using, for example, ethanol and isopropyl alcohol as a solvent is applied that is excellent in handwriting drying properties and erasability when being written. An ink composition applied to the present invention is not limited to the above type and may be oil based ink not containing a remover or water based ink containing water as a main solvent.

As a specific method of using the writing instrument 1 of the present invention, the ink cartridge 6 is inserted from the rear end opened area of the writing instrument body (barrel 2) and is further rotated forward, thereby screw inserting the cartridge 6 into the barrel 2 to make the rear end of the projection 52 contact with the plug 8, and by further being rotated, the rear end of the projection 52 presses rearward the plug 8 to open the cartridge. At that time, the outer surface of the projection 52 is air tight fitted in the inner circumferential surface of the opening 72 to be in a cartridge connected state. The opened plug 8 is restricted in movement in the bottom surface direction in the stepped portion 76 formed in the inner circumference in the container 7 and also still retained near the opening by making contact with the projection 52.

Then, the ink in the ink cartridge 6 flows into the channel 54 from the ink intake portion 53 (notches) formed in a rear end side surface of the projection 52, and the ink is supplied to the pen point 3 through the ink guiding portions 51 to be in a writing state.

When the ink cartridge 6 is detached after ink consumption, the cartridge 6 (opening 72) may be disengaged from the projection 52 by pulling the cartridge 6 rearward while it is rotated. At this point, as long as the pen point 3 is oriented downward even slightly, the plug 8 follows when the projection 52 in the fitted state moves in a direction of the opening 72 of the cartridge 6, and the opening is blocked instantaneously by the tapered portion 74. Therefore, even when the cartridge 6 is disengaged without taking care of the position of the pen point 3 (that is, orientation of the opening 72) when the cartridge is replaced, inappropriate leakage of remained ink may be prevented securely.

DESCRIPTION OF REFERENCE NUMERALS

1 Writing Instrument
2 Barrel
21 Thread Ridge (Female Thread)
3 Pen Point
4 Ink Absorber
5 Intermediate Member
51 Ink Guiding Portion (Communication Pipe)
52 Projection (Ink-Guiding Tube)
53 Ink Intake Portion (Notch)
54 Channel
6 Ink Cartridge
7 Container
71 Ink Storage Portion
72 Opening
73 Thread Ridge (Male Thread)
74 Taper
75 Rib
76 Stepped Portion (Abutting Portion)
8 Plug
81 Smaller Diameter Area
82 Larger Diameter Area
101 Writing Instrument
102 Writing Instrument Body
120 Barrel
121 Thread Ridge (Female Thread)
103 Pen Point
104 Ink Absorber
105 Intermediate Member
106 Cap
151 Ink Guiding Portion (Communication Pipe)
152 Projection
153 Air Tight Connection Portion
154 Channel (Groove)
155 Small Protrusion (Male Fitting Portion)
**155*a*** Convex Portion (First Shape)
106 Ink Cartridge
107 Container
171 Ink Storage Portion
172 Opening
**172*a*** Cylindrical Inner Circumferential Surface
**172*b*** Tapered Inner Circumferential Surface
173 Thread Ridge (Male Thread)
175 Rib
**175*a*** Abutting Portion
108 Plug
181 Plug Portion
**181*a*** Bulge
182 Ink Intake Portion
**182*a*** Rod-Like Member
**182*b*** Annular Member
**182*c*** Interval
183 Small Bore (Female Fitting Portion)
**183*a*** Annular Convex Portion (Second Shape)
**183*b*** Annular Concave Portion (Second Shape)
201 Writing Instrument
202 Writing Instrument Body
220 Barrel
221 Thread Ridge (Female Thread)
203 Pen Point
204 Ink Absorber
205 Intermediate Member
206 Cap
251 Ink Guiding Portion (Communication Pipe)
252 Projection (Ink-Guiding Tube)
253 Pressing Piece (Male Fitting Portion)
206 Ink Cartridge
207 Container
271 Ink Storage Portion
272 Opening
273 Thread Ridge (Male Thread)
208 Plug
281 clamping Piece (Female Fitting Portion)
209 End Plug

The invention claimed is:

1. A writing instrument, comprising: a writing instrument body provided with a pen point to be a writing tip end at a front end of a barrel; and a replacement ink cartridge provided with a tubular container having an opened front end and a closed rear end, wherein the ink cartridge has a plug fitted in an inner circumferential surface of an opening of the container and blocking the opening, the writing instrument body has a projection pressing the plug rearward when inserted into the opening of the container to release fitting between the plug and the inner circumferential surface of the opening of the container, the fitting between the plug and the inner circumferential surface of the opening of the container is released in a procedure of attaching the ink cartridge to the writing instrument body, the plug blocks the opening of the container again in a procedure of detaching the ink cartridge from the writing instrument body, and the projection is an ink-guiding tube having an outer circumferential surface to be air tight fitted in the inner circumferential surface of the opening of the container and the ink-guiding tube has a wall provided with an ink intake portion allowing ink to flow through the ink-guiding tube in a state of fitting in the plug.

2. The writing instrument according to claim 1, wherein the projection and the plug are fitted in the procedure of attaching the ink cartridge to the writing instrument body, and in the procedure of detaching the ink cartridge from the writing instrument body, fitting between the projection and the plug is released and the plug is fitted again in the inner circumferential surface of the opening of the container.

3. The writing instrument according to claim 1, wherein the inner circumferential surface of the opening of the container is formed in a tapered shape widened rearwardly.

4. An ink cartridge constituting the writing instrument according to claim 1, having the plug fitted in the inner circumferential surface of the opening of the container, wherein the plug is, in the procedure of attaching the ink cartridge to the writing instrument body, pressed rearward by the projection to release the fitting with the inner circumferential surface of the opening of the container and to be fitted in the projection, and, in the procedure of detaching the ink cartridge from the writing instrument body, releases the fitting with the projection and is fitted again in the inner circumferential surface of the opening of the container, and the inner circumferential surface of the opening of the container is formed in a tapered shape widened rearwardly.

5. An ink cartridge attachable to the writing instrument body constituting the writing instrument according to claim 1, wherein at least a front end side of the container has a shape and a dimension attachable in the barrel of the writing instrument body, and when the container is attached in the barrel of the writing instrument body, ink stored in the container is supplied from the opening of the container to the pen point provided at the front end of the barrel of the writing instrument body, the container has an outer circumferential surface formed with a male thread and the male thread is screwed to a female thread formed in an inner circumferential surface of a rear end opened area of the barrel of the writing instrument body.

6. The ink cartridge according to claim 5, having the plug fitted in the inner circumferential surface of the opening of the container, wherein the plug is, when the projection is inserted into the opening of the container, pressed rearward by the projection to release the fitting with the inner circumferential surface of the opening of the container.

7. A writing instrument, comprising: a writing instrument body provided with a pen point to be a writing tip end at a front end of a barrel; and a replacement ink cartridge provided with a tubular container having an opened front end and a closed rear end, wherein the ink cartridge has a plug fitted in an inner circumferential surface of an opening of the container and blocking the opening, the writing instrument body has a projection pressing the plug rearward when inserted into the opening of the container to release fitting between the plug and the inner circumferential surface of the opening of the container, and any one of the plug and the projection is provided with a male fitting portion and the other is provided with a female fitting portion, wherein the fitting between the plug and the inner circumferential surface of the opening of the container is released in a procedure of attaching the ink cartridge to the writing instrument body, the plug is fitted again in the inner circumferential surface of the opening of the container in a procedure of detaching the ink cartridge from the writing instrument body, the male fitting portion and the female fitting portion are fitted in the procedure of attaching the ink cartridge to the writing instrument body, and, in the procedure of detaching the ink cartridge from the writing instrument body, fitting between the male fitting portion and the female fitting portion is released.

8. The writing instrument according to claim 7, wherein the male fitting portion is a small protrusion with a diameter less than diameters of the plug and the projection and the female fitting portion is a small bore smaller than the diameters of the plug and the projection, in the procedure of attaching the ink cartridge to the writing instrument body, the small protrusion is inserted into the small bore and the small protrusion is fitted in the small bore, and, in the procedure of detaching the ink cartridge from the writing instrument body, fitting between the small protrusion and the small bore is released and the plug is fitted again in the inner circumferential surface of the opening of the container.

9. The writing instrument according to claim 8, wherein a part of an outer circumferential surface of the small protrusion is provided with a first shape and a part of an inner circumferential surface of the small bore is provided with a second shape corresponding to the first shape, and a fitted state of the small protrusion and the small bore is formed by coupling the first shape to the second shape.

10. The writing instrument according to claim 7, wherein the plug is provided with a plug portion having an outer circumferential surface capable of being fitted in the inner circumferential surface of the opening of the container and an ink intake portion provided in a rear of the plug portion and allowing ink in the container to flow therethrough.

11. The writing instrument according to claim 7, wherein the inner circumferential surface of the opening of the container includes a cylindrical inner circumferential surface with an identical diameter provided in a front and a tapered inner circumferential surface with a rearwardly increasing diameter continuously provided in a rear of the cylindrical inner circumferential surface.

12. The writing instrument according to claim 7, wherein the projection is an ink-guiding tube having an outer circumferential surface to be air tight fitted in the inner circumferential surface of the opening of the container and a pressing piece partially projecting from a periphery of a wall portion of the ink-guiding tube configures the male fitting portion, the plug is a plate member fitted in the inner circumferential surface of the opening of the container and a clamping piece provided in a peripheral portion of the plug configures the female fitting portion, the pressing piece and the clamping piece are fitted in the procedure of attaching the ink cartridge to the writing instrument body, and, in the procedure of detaching the ink cartridge from the writing instrument body, fitting between the pressing piece and the clamping piece is released and the plug is fitted again in the inner circumferential surface of the opening of the container.

13. An ink cartridge constituting the writing instrument according to claim 7, having the plug fitted in the inner circumferential surface of the opening of the container, wherein the plug is provided with any one of the male fitting portion or the female fitting portion, and the plug is, in the procedure of attaching the ink cartridge to the writing instrument body, pressed rearward by the projection to release the fitting with the inner circumferential surface of the opening of the container and the male fitting portion or the female fitting portion provided in the plug is fitted in the female fitting portion or the male fitting portion provided in the projection, and in the procedure of detaching the ink cartridge from the writing instrument body, releases fitting between the male fitting portion or the female fitting portion provided in the plug and the female fitting portion or the male fitting portion provided in the projection and is fitted again in the inner circumferential surface of the opening of the container.

14. The ink cartridge according to claim 13, wherein the male fitting portion is a small protrusion with a diameter less than diameters of the plug and the projection and the female fitting portion is a small bore smaller than the diameters of the plug and the projection, the plug is provided with any one of the small protrusion or the small bore, in the procedure of attaching the ink cartridge to the writing instrument body, the small protrusion or the small bore provided in the plug is fitted in the small bore or the small protrusion provided in the projection, and, in the procedure of detaching the ink cartridge from the writing instrument body, fitting between the small protrusion or the small bore provided in the plug and the small bore or the small protrusion provided in the projection is released and the plug is fitted again in the inner circumferential surface of the opening of the container.

15. The ink cartridge according to claim 13, wherein the plug is provided with a plug portion having an outer circumferential surface capable of being fitted in the inner circumferential surface of the opening of the container and an ink intake portion provided in a rear of the plug portion and allowing ink in the container to flow therethrough.

16. The ink cartridge according to claim 13, wherein the container is in a cylindrical shape with the opened front end and the closed rear end and has an outer diameter on a front end side to be inserted into a rear end opened area of the barrel of the writing instrument body of 12 mm or less.

17. The ink cartridge according to claim 16, wherein the opening of the container has an inner diameter within a range from 3 to 8 mm.

18. A writing instrument, comprising: a writing instrument body provided with a pen point to be a writing tip end at a front end of a barrel; and a replacement ink cartridge provided with a tubular container having an opened front end and a closed rear end, wherein the ink cartridge has a plug fitted in an inner circumferential surface of an opening of the container and blocking the opening, the writing instrument body has a projection pressing the plug rearward when inserted into the opening of the container to release fitting between the plug and the inner circumferential surface of the opening of the container, the fitting between the plug and the inner circumferential surface of the opening of the container is released in a procedure of attaching the ink cartridge to the writing instrument body, and the plug blocks the opening of the container again in a procedure of detaching the ink cartridge from the writing instrument body, the writing instrument further comprising:

the ink cartridge including the container in a bottomed cylindrical shape having the opened front end and the closed rear end and the plug fitted into the inner circumferential surface of the opening of the container; and the projection inserted into the opening of the container to press the plug rearward, thereby opening the plug of the ink cartridge, wherein, when the ink cartridge is connected, the press opened plug is in a state of approximately making contact with the projection and the plug is approximately clamped by the projection and a part of an inner wall of the container and its movement is suppressed, and, when the ink cartridge is replaced in a state of the opening of the container oriented downward, the plug moves by its own weight to be locked again in the opening of the container.

19. The writing instrument according to claim 18, wherein a stepped portion is formed in the part of the inner wall of the container, and when the ink cartridge is connected, the stepped portion, together with the projection, restricts the movement of the plug.

20. The writing instrument according to claim 19, wherein the stepped portion is a longitudinal rib formed in the inner wall of the container, a plurality of which are formed in an inner circumference of the container.

21. The writing instrument according to claim 18, wherein an inner circumference of the opening of the container is formed in a tapered shape widened rearwardly.

22. The writing instrument according to claim 18, wherein the projection is an ink-guiding tube air tight fitted in an inner circumference of the opening of the container and the ink-guiding tube has a wall provided with an ink intake portion for intake of ink in a state of making contact with the plug.

23. An ink cartridge attachable to the writing instrument body constituting the writing instrument according to claim 18, having the plug fitted in the inner circumferential surface of the opening of the container, wherein the plug is, when the ink cartridge is connected, in the state of approximately making contact with the projection and is approximately clamped by the projection and a part of an inner wall of the container and its movement is suppressed, and, when the ink cartridge is replaced in the state of the opening of the container oriented downward, moves by its own weight to be locked again in the opening of the container.

* * * * *